US007900705B2

(12) United States Patent
Patel

(10) Patent No.: US 7,900,705 B2
(45) Date of Patent: Mar. 8, 2011

(54) FLOW CONTROL ASSEMBLY HAVING A FIXED FLOW CONTROL DEVICE AND AN ADJUSTABLE FLOW CONTROL DEVICE

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 462 days.

(21) Appl. No.: 11/948,201

(22) Filed: Nov. 30, 2007

(65) Prior Publication Data

US 2009/0008078 A1 Jan. 8, 2009

Related U.S. Application Data

(60) Provisional application No. 60/894,495, filed on Mar. 13, 2007, provisional application No. 60/895,555, filed on Mar. 19, 2007.

(51) Int. Cl.
*E21B 34/00* (2006.01)
*E03B 3/11* (2006.01)

(52) U.S. Cl. ..... 166/319; 166/313; 166/50; 166/373

(58) Field of Classification Search ..... 166/50, 166/316, 205, 153, 117.5, 373, 64, 66.4, 166/66.6

See application file for complete search history.

(56) References Cited

U.S. PATENT DOCUMENTS

| | | | | |
|---|---|---|---|---|
| 5,325,924 | A * | 7/1994 | Bangert et al. | 166/313 |
| 5,597,042 | A | 1/1997 | Tubel | |
| 5,941,308 | A | 8/1999 | Malone | |
| 5,992,519 | A | 11/1999 | Ramakrishnan | |
| 6,209,648 | B1 | 4/2001 | Ohmer | |
| 6,481,494 | B1 | 11/2002 | Dusterhoft | |
| 6,679,324 | B2 * | 1/2004 | Den Boer et al. | 166/66.6 |
| 7,187,620 | B2 | 3/2007 | Nutt | |
| 2002/0096333 | A1 | 7/2002 | Johnson | |
| 2002/0112857 | A1 * | 8/2002 | Ohmer et al. | 166/313 |
| 2004/0238168 | A1 | 12/2004 | Echols | |
| 2006/0042795 | A1 | 3/2006 | Richards | |
| 2007/0227727 | A1 | 10/2007 | Patel | |
| 2007/0235185 | A1 | 10/2007 | Patel | |
| 2007/0289779 | A1 | 12/2007 | Howard | |

FOREIGN PATENT DOCUMENTS

| | | |
|---|---|---|
| GB | 2376488 | 12/2002 |
| GB | 2392461 | 3/2004 |
| GB | 2404676 | 9/2005 |
| GB | 2436579 | 10/2007 |
| GB | 2440232 | 1/2008 |
| WO | 2007126496 | 11/2007 |

* cited by examiner

*Primary Examiner* — David J Bagnell
*Assistant Examiner* — Yong-Suk Ro
(74) *Attorney, Agent, or Firm* — Brandon S. Clark; Rodney Warfford

(57) ABSTRACT

An apparatus for use in a well includes a flow control assembly to control fluid flow in a first zone of the well, where the flow control assembly has a fixed flow control device and an adjustable flow control device that cooperate to control the fluid flow in the first zone.

15 Claims, 35 Drawing Sheets

FLOW CONTROL ASSEMBLY HAVING A FIXED FLOW CONTROL DEVICE AND AN ADJUSTABLE FLOW CONTROL DEVICE

CROSS-REFERENCE TO RELATED APPLICATIONS

This claims the benefit under 35 U.S.C. §119(e) of U.S. Provisional Application Ser. No. 60/894,495, entitled "Method and Apparatus for an Active Integrated Well Construction and Completion System for Maximum Reservoir Contact and Hydrocarbon Recovery," filed Mar. 13, 2007; and of U.S. Provisional Application Ser. No. 60/895,555, entitled, "Method and Apparatus for an Active Integrated Well Construction and Completion System for Maximum Reservoir Contact and Hydrocarbon Recovery," filed Mar. 19, 2007, both hereby incorporated by reference.

TECHNICAL FIELD

The invention relates generally to controlling fluid flow in one or more zones of a well using a flow control assembly having a fixed flow control device and an adjustable flow control device.

BACKGROUND

A completion system is installed in a well to produce hydrocarbons (or other types of fluids) from reservoir(s) adjacent the well, or to inject fluids into the reservoirs) through the well. Typically, one or more flow control devices are provided to control flow in one or more zones of the well.

In a complex completion system, such as a completion system installed in a well that have many zones, many adjustable flow control devices may have to be deployed. An adjustable flow control device is a flow control device that can be actuated between different settings to provide different amounts of flow. However, adjustable flow control devices can be relatively expensive, and having to deploy a relatively large number of such adjustable flow control devices can increase costs.

SUMMARY

In general, according to an embodiment, a flow control assembly to control fluid flow in a zone of the well includes at least a fixed flow control device and an adjustable flow control device that cooperate to control the fluid flow in the zone.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
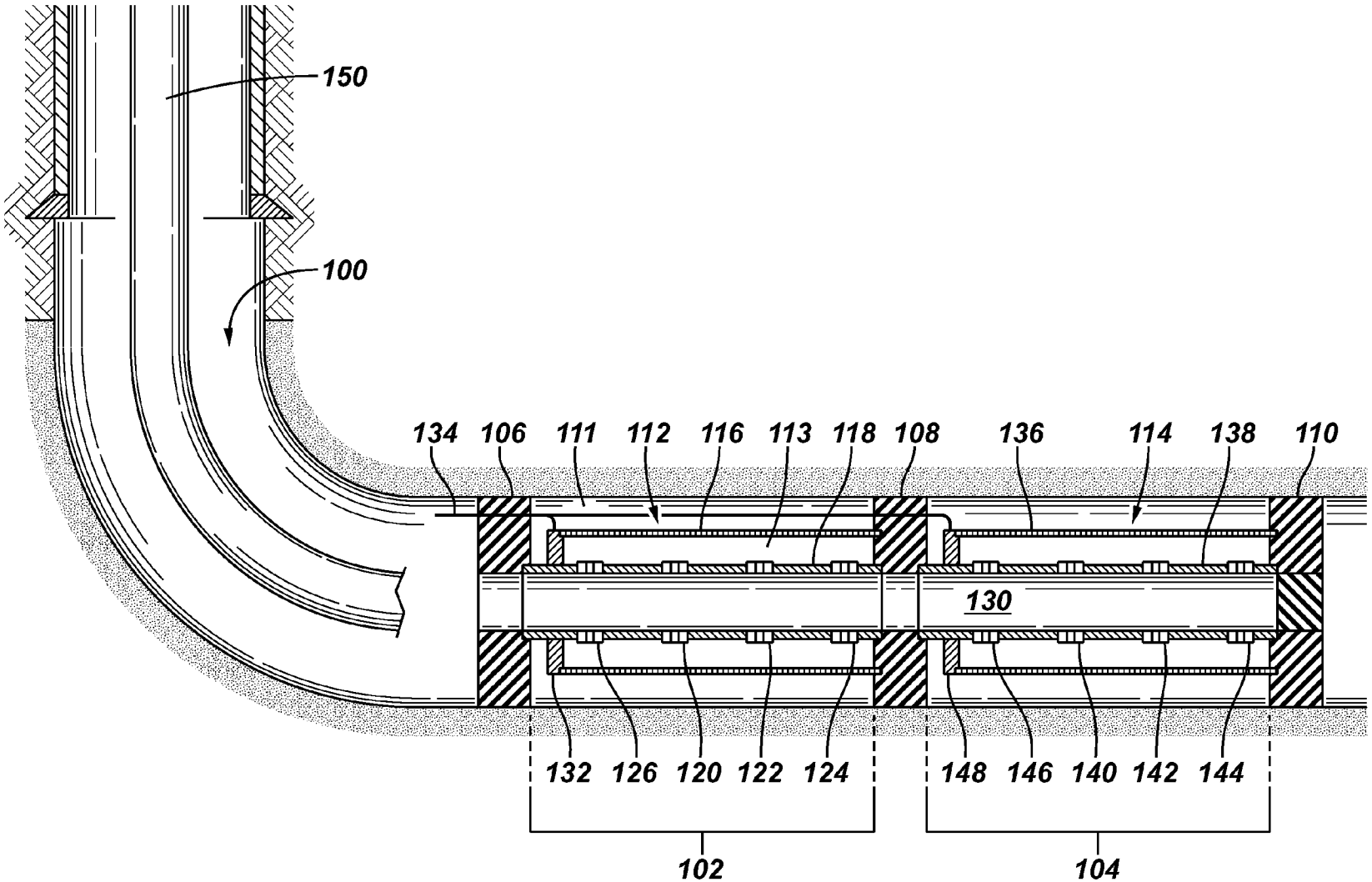
FIGS. 1-4 illustrate different embodiments of completion systems that can be deployed in a wellbore.

FIG. 1 illustrates an example completion system that is deployed in a well 100. As depicted in FIG. 1, several zones 102 and 104 are defined in the well 100 by isolation packers 106, 10S, and 110. The isolation packers 106, 108, and 110 can be swellable packers that swell in the downhole environment, or alternatively, the isolation packers can be compression-based packers that are set by application of hydraulic pressure, for example.

Each zone 102, 104 includes a flow control assembly 112, 114, respectively. The flow control assembly 112 includes a screen, such as a wire-wrapped screen 116, which can be used to perform sand control or control of other particulates (to prevent such particulates from flowing into an inner conduit of the flow control assembly 112). Inside the screen 116 is a mandrel 118 on which various flow control devices are arranged, including fixed flow control devices 120, 122, and 124, and an adjustable flow control device 126. The need for using a screen or not using a screen depends on the type of formation. Typically soft formation such as sand stone requires running a screen for preventing sand or solids production. A hard formation such as carbonate may not require a screen. However, sometime a screen is run in carbonate to prevent solids from plugging the flow control valves. A "fixed" flow control device is a flow control device whose flow path cannot be adjusted after being installed in the well. Examples of a fixed flow control device include an orifice, a tortuous flow path, or any other device that provides a pressure drop. An "adjustable flow control device" is a flow control device whose path can be adjusted after being installed in the well to different settings, including a closed setting (in which no fluid flow is allowed through the adjustable flow control device), a fully open setting (in which the flow path is at its maximum to allow maximum fluid flow through the adjustable flow control device), and one or more intermediate settings (to provide different amounts of flow across the adjustable flow control device).

In one example implementation, the flow control devices 120, 122, 124, and 126 are considered inflow control devices that control the incoming flow from surrounding reservoir through the flow control devices into an inner bore 130 of the completion system depicted in FIG. 1. However, in a different implementation, the flow control devices can control outflow of fluid from the inner bore 130 into the surrounding reservoir (such as in the injection context).

In the inflow direction, fluid flows from the reservoir into a well annular region 111 outside the screen 116, and then through the screen 116 to an annular region 113 between the screen 116 and the mandrel 118. The fluid flow then continues through the flow control devices 120-126 and into the inner bore 130 for flow toward an earth surface, such as through a tubing 150.

In the example depicted in FIG. 1, the adjustable flow control device 126 is electrically coupled through a connection sub 132 to an electrical cable 134, which can extend from the earth surface. The electrical cable 134 runs through the isolation packer 106 and also through the isolation packer 108. Instead of using the electrical cable 134, a fiber optic cable or other power and telemetry mechanisms can be used.

The flow control assembly 114 for the second zone 104 similarly includes a screen 136, as well as a mandrel 138 on which are mounted fixed flow control devices 140, 142, and 144, as well as an adjustable flow control device 146 that is electrically coupled through a connection sub 148 to the electrical cable 134.

As depicted in FIG. 1, the section of the completion system that includes the two flow control assemblies 112 and 114 is positioned in a deviated or horizontal section of the well 100. Alternatively, the section of the completion system can also be deployed in a lateral branch of a multilateral well. In a different implementation, the completion system section can be provided in a vertical section of the well 100.

Although just two zones are depicted in FIG. 1, it is noted that additional zones of the well can be defined with the completion system in other implementations, with additional flow control assemblies similar to flow control assemblies 112 and 114 provided to control flow in these other zones. By using the completion system according to some embodiments, a particular reservoir can be compartmentalized into separate zones, where each zone is isolated from the other by isolation packers. A flow control assembly is provided in each zone to provide for independent control of fluid flow in each zone.

Within each zone, the flow control devices of the flow control assembly are provided to achieve a desired pressure drop from the reservoir into the inner bore 130 of the completion system. Different pressure drops can be set in different zones so that a target pressure profile can be achieved along the length of the completion system. Controlling the production profile by controlling pressure drops along the completion system in different zones has several benefits, including the reduction or avoidance of water or gas coning or other adverse effects. Water or gas coning refers to the production of unwanted water or gas prematurely, which can occur at the "heel" of the well (the zone nearer the earth surface) before zones near the "toe" of the well (the zones farther away from the earth surface). Production of unwanted water or gas in any of the zones may require special intervention that can be expensive.

By using the combination of fixed flow control device(s) and adjustable flow control device(s) that cooperate to provide the target flow control in each zone, costs can be reduced. Fixed flow control devices are relatively cheap to provide, as compared to adjustable flow control devices, which are higher cost devices.

Figure 2:
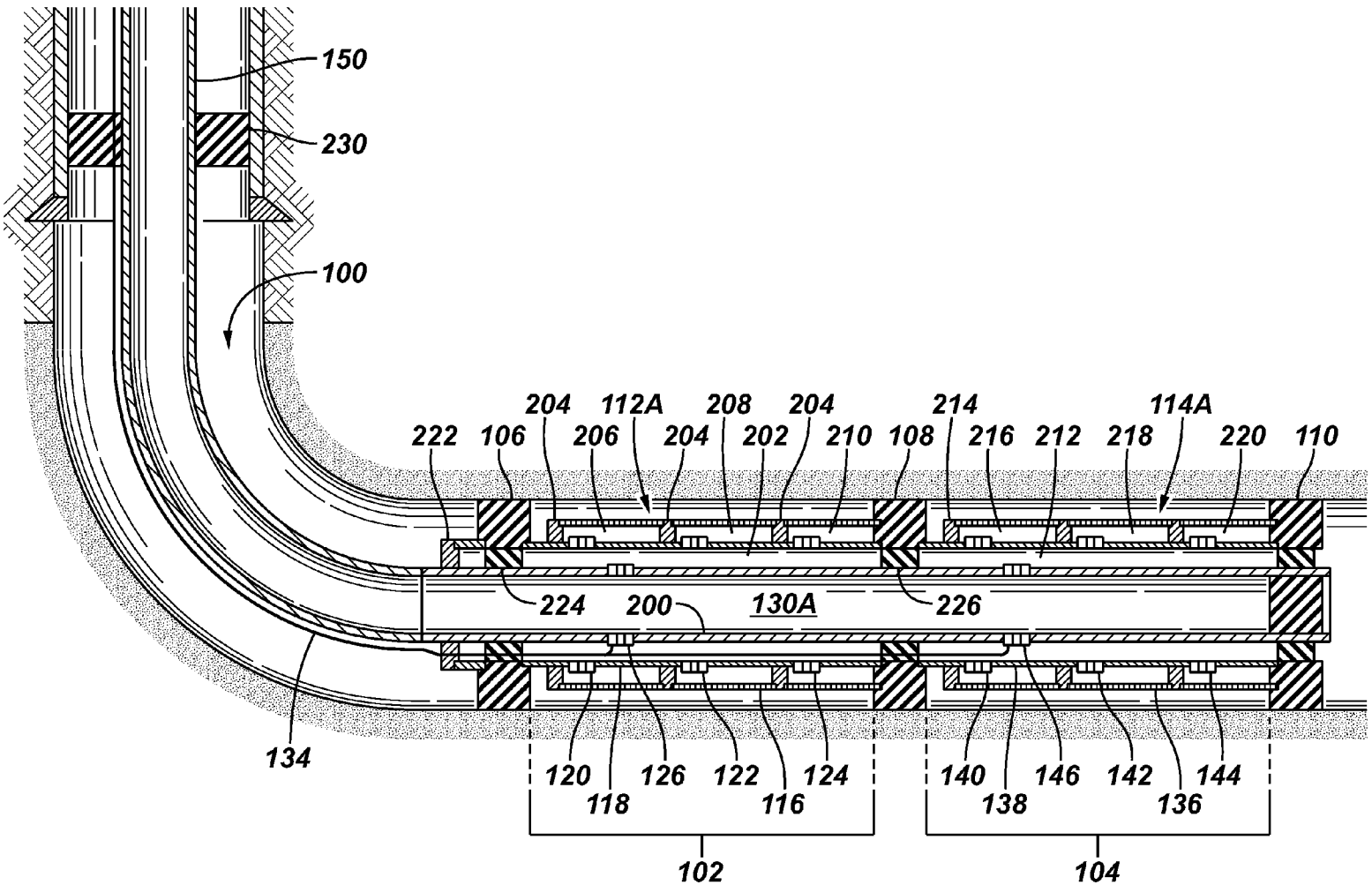

FIG. 2 shows an alternative embodiment of a completion system that defines multiple zones 102, 104 in a section of a well 100. Different embodiments of flow control assemblies 112A and 114A are provided in the respective zones 102 and 104. The flow control assembly 112A includes the screen 116, as well as the mandrel 118 on which fixed flow control devices 120, 122, and 124 are mounted. However, in the embodiment of FIG. 2, the adjustable flow control device 126 is provided on an inner pipe 200 that is concentrically provided inside the mandrel 118. An annular space 202 is defined between the mandrel 118 and the pipe 200. This arrangement of the flow control device 126 is contrasted with the flow control device 126 arranged on the mandrel 118 in FIG. 1.

Also, in FIG. 2, sealing elements 204 are provided inside the screen 116 such that multiple annular spaces 206, 208, and 210 are defined inside the screen 116. Fluid flows through the screen 116 into the annular spaces 206, 208, 210, and then through corresponding fixed flow control devices 120, 122, and 124 into the annular space 202 between the mandrel 118 and the pipe 200. The fluid flows through the adjustable flow control device 126 into an inner bore 130A of the pipe 200 for production to the earth surface.

The flow control assembly 114A similarly includes the outer screen 136 and the inner mandrel 138. Also, the pipe 200 is concentrically defined inside the mandrel 138 such that an annular space 212 is defined between the pipe 200 and the mandrel 138. Also, sealing elements 214 are provided inside the screen 136 to define annular spaces 216, 218, and 220 between the screen 136 and the mandrel 138. Fluid flows from the reservoir through the screen 136, annular spaces 216, 218, and 220, and through respective fixed flow control devices 140, 142, and 144 on the mandrel 138 into the annular space 212 between the mandrel 138 and the pipe 200. The fluid then flows through the adjustable flow control device 146 that is mounted on the pipe 200 to allow fluid flow into the inner bore 130A of the pipe 200.

Note that the annular spaces 202 and 212 between mandrels 118, 138, and the pipe 200 are defined by sealing elements 224, 226, and 227.

In the embodiment of FIG. 2, the cable 134 extends through a sub 222 attached to the isolation packer 106, through the sealing element 224 and into the annular space 202 between the mandrel 118 and the pipe 200. Inside the annular space 202, the cable 134 is electrically connected to the adjustable flow control device 126. The cable 134 further extends through the sealing element 226 into the annular space 212, where the cable 134 is electrically connected to the adjustable flow control device 146.

The lower section of the completion system including the isolation packers 106, 108, 110 and the flow control assemblies 112A, 114A are connected to an upper completion section that includes tubing 150 and production packer 230. In some implementations, the upper and lower sections can be run into the well 100 in a single trip. In a different implementation, the lower completion section can be run into the well 100 first, followed later by run-in of the upper completion section for engagement with the lower completion section.

The types of adjustable flow control devices that can be used in various embodiments includes sliding sleeve valves, cartridge-type valves, inflatable valves, ball valves, and so forth. In FIGS. 1 and 2, the actuation technique is an electric-based actuation technique, in which signals provided over the electrical cable 134 are used to actuate the adjustable flow control devices. In different embodiments, other actuation techniques can be used, including hydraulic actuation, electro-hydraulic actuation, smart fluid actuation, shaped memory alloy actuation, and electromagnetic actuation. Smart fluid actuation refers to a fluid that expands in response to electromagnetic activation. Shaped memory alloy actuation refers to the use of a shaped memory material to perform actuation.

In addition to flow control devices, other components can also be deployed in a completion system, according to some embodiments. For example, sensors can also be provided, such as pressure sensors, temperature sensors, flow rate sensors, fluid identification sensors, flow control valve position detection sensors, density detection sensors, chemical detection sensors, pH detection sensors, viscosity detection sensors, acoustic sensors, and so forth.

Communication between sensors and/or flow control devices can be accomplished using electrical signaling, hydraulic signaling, fiber optic signaling, wireless signaling, or any combination of the above. Power can be provided to electrical devices, such as sensors and adjustable flow control devices, from the earth surface, from a downhole generator, from a charge storage device such as a capacitor or battery, from activation of an explosive or other ballistic device, from chemical activation, or any combination of the above.

Figure 3:
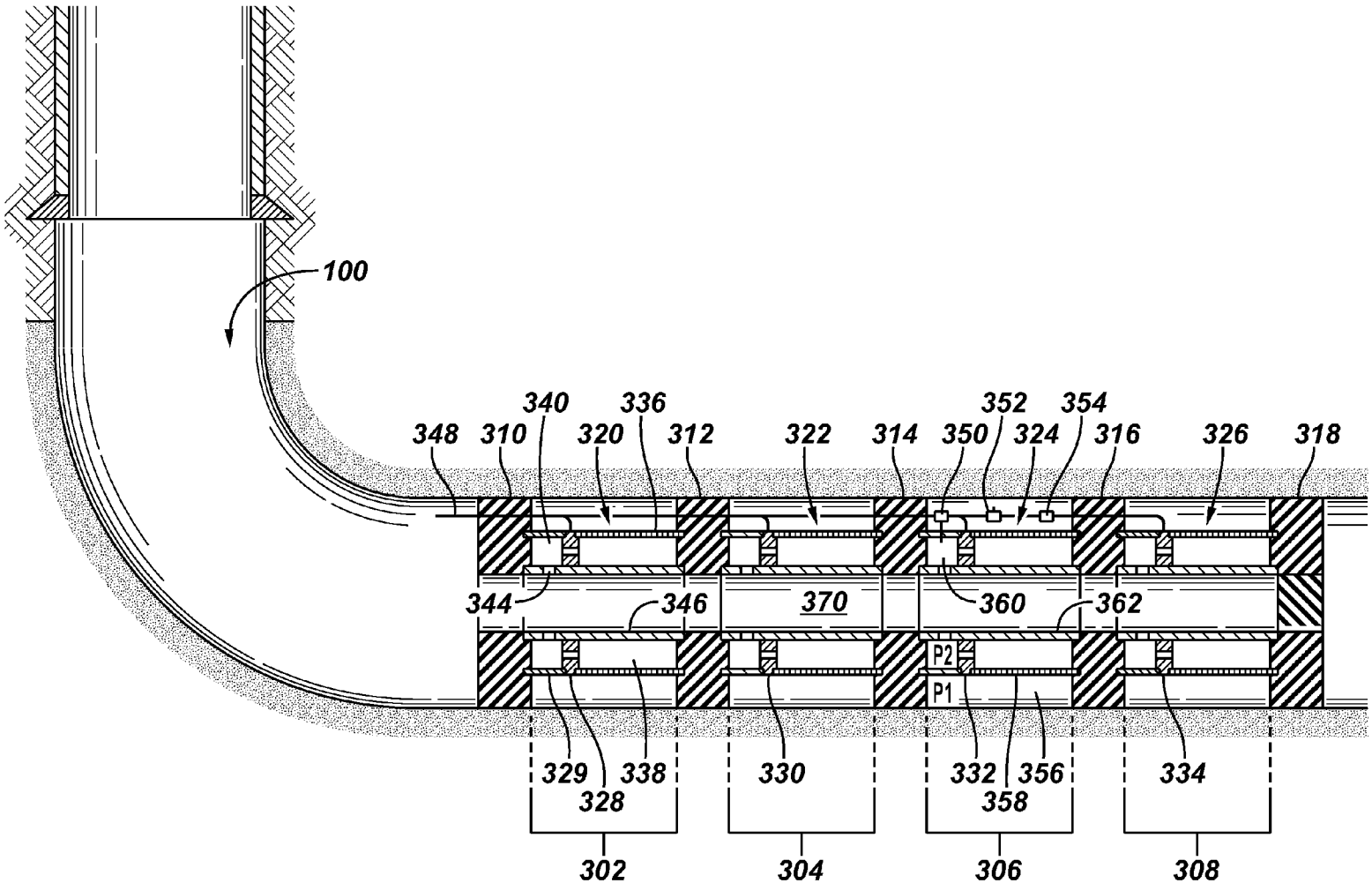

FIG. 3 shows another embodiment of a completion system in which flow control assemblies are provided. FIG. 3 shows four isolated zones 302, 304, 306, and 308 as defined by isolation packers 310, 312, 314, 316, and 318. Four flow control assemblies 320, 322, 324, and 326 are provided in the respective zones 302, 304, 306, and 308. Each flow control assembly includes an adjustable flow control device, including an adjustable flow control device 328 in the flow control assembly 320, an adjustable flow control device 330 in the flow control assembly 322, an adjustable flow control assembly 332 in the flow control assembly 324, and an adjustable flow control device 334 in the flow control assembly 326.

The flow control assembly 320 includes a screen 336 through which fluid can flow into a first annular space 338 of the flow control assembly 320 between the screen 336 and mandrel 346. The adjustable flow control device 328 is positioned between the first annular space 338 and a second annular space 340 of the flow control assembly 320 between an outer housing member 329 and the mandrel 346. The flow control device 328 has a flow path 342 to allow for fluid communication between the annular spaces 338 and 340. The adjustable flow control device 328 is positioned between the screen 320 and the inner mandrel 346. In addition, a fixed flow control device 344 is defined on the inner mandrel 346. The fixed flow control device 344 allows for fluid to flow from the second annular space 340 to an inner bore 370 of the completion system.

The adjustable flow control device 328 is controllable by an electrical cable 348. Signaling provided over the electric cable 348 can be used to control the setting of the adjustable flow control device 328.

The other flow control assemblies 322, 324, and 326 can have identical arrangements as the flow control assembly 320.

Additionally, in the zone 306, sensors 350, 352, and 354 are provided in an annulus region 356 outside a screen 358 of the flow control assembly 324. In some implementations, the sensors 350, 352, and 354 can be part of the cable 348, thereby making the cable 348 a sensor cable that can have other sensors. A sensor cable (also referred to a "sensor bridle") is basically a continuous control line having portions in which sensors are provided. The sensor cable is continuous in the sense that the sensor cable provides a continuous seal against fluids, such as wellbore fluids, along its length. Note that in some embodiments, the continuous sensor cable can actually have discrete housing sections that are sealably attached together (e.g., welded). In other embodiments, the sensor cable can be implemented with an integrated, continuous housing without breaks.

In one example implementation, the sensors 350 and 352 can be pressure sensors, with sensor 352 detecting pressure P1 in the annulus region 356 outside the screen 358 and the sensor 350 sensing pressure P2 in an annular space 360 downstream of the adjustable flow control device 332 between the screen 358 and an inner mandrel 362 of the flow control assembly 324. Using the sensors 350 and 352, the pressure difference between the annulus region 356 and the outlet of the adjustable flow control device 332 can be determined.

The third sensor 354 can be a fluid identification sensor to detect the type of fluid that is in the annulus region 356. Other or alternative sensors can be provided, such as temperature sensors or other types of sensors.

Figure 4:
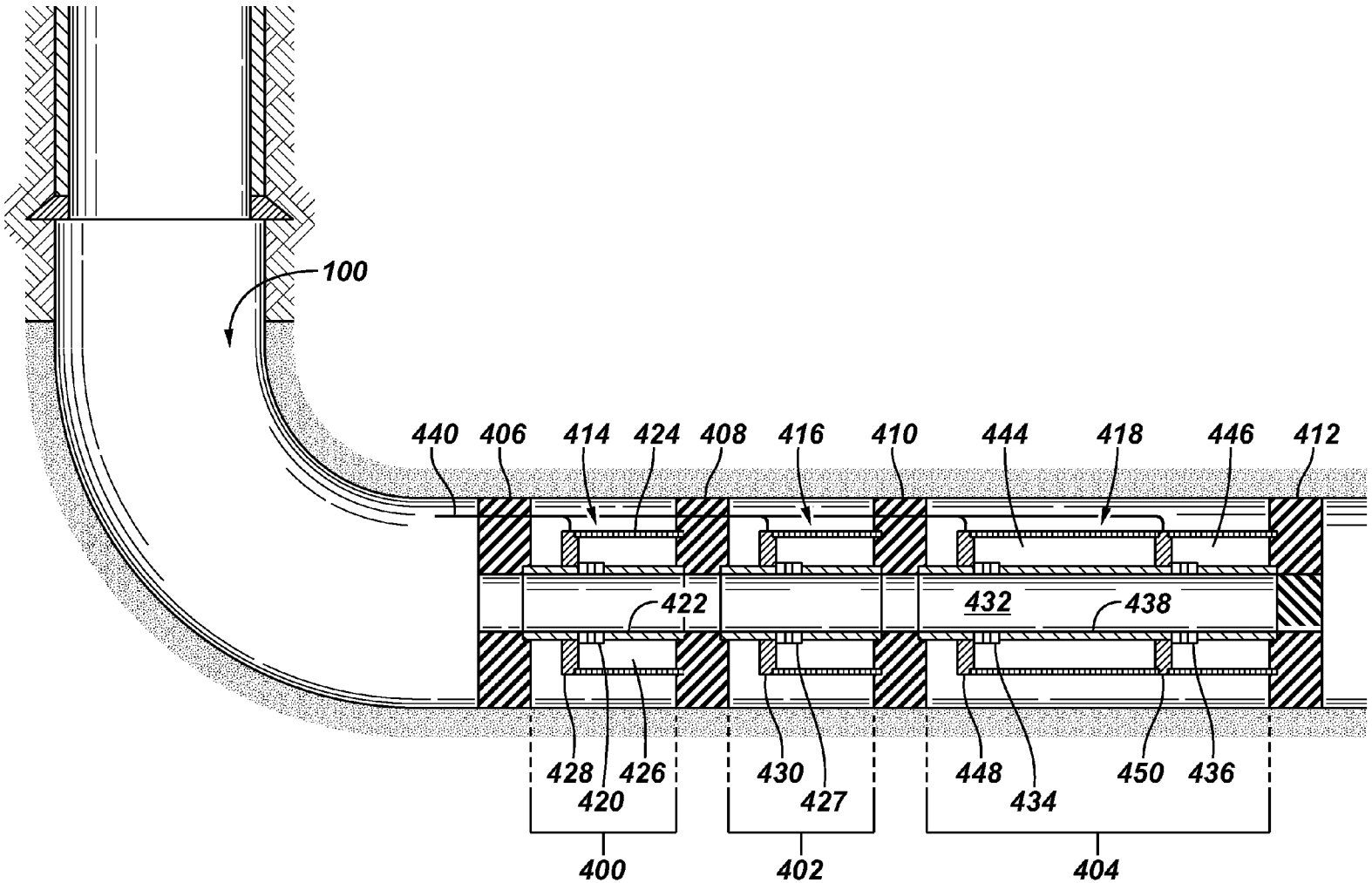

FIG. 4 shows yet another embodiment of a completion system that can be provided in a section of a well. In the embodiment of FIG. 4, three zones 400, 402, and 404 are defined by isolation packers 406, 408, 410, and 412.

Flow control assemblies 414, 416, and 418 are provided in corresponding zones 400, 402, and 404. In the zone 400, an adjustable flow control device 420 is mounted on an inner mandrel 422 of the flow control assembly 414. The flow control assembly 414 also includes a screen 424 through which fluid can flow into an annulus space 426 defined between sealing elements 428 and 408. Fluid flowing into the annulus space 426 flows out of the flow control device 420 into an inner bore 432 of the completion system.

The flow control assembly 416 is similarly arranged as the flow control assembly 414, and includes an adjustable flow control device 427. The flow control assembly 418 has two adjustable flow control devices 434 and 436 mounted on an inner mandrel 438 to control flow into the inner bore 432 of the completion system. The flow control assembly 418 also includes annular spaces 444 and 446 defined between sealing elements 448, 450, and the isolation packer 412.

The adjustable flow control devices 420, 427, 434, and 436 are controlled by signaling over an electrical cable 440. The adjustable flow control devices can be one or more of the following types of flow control devices: sliding sleeve type, cartridge type, inflatable type, and ball type.

Figure 5A:
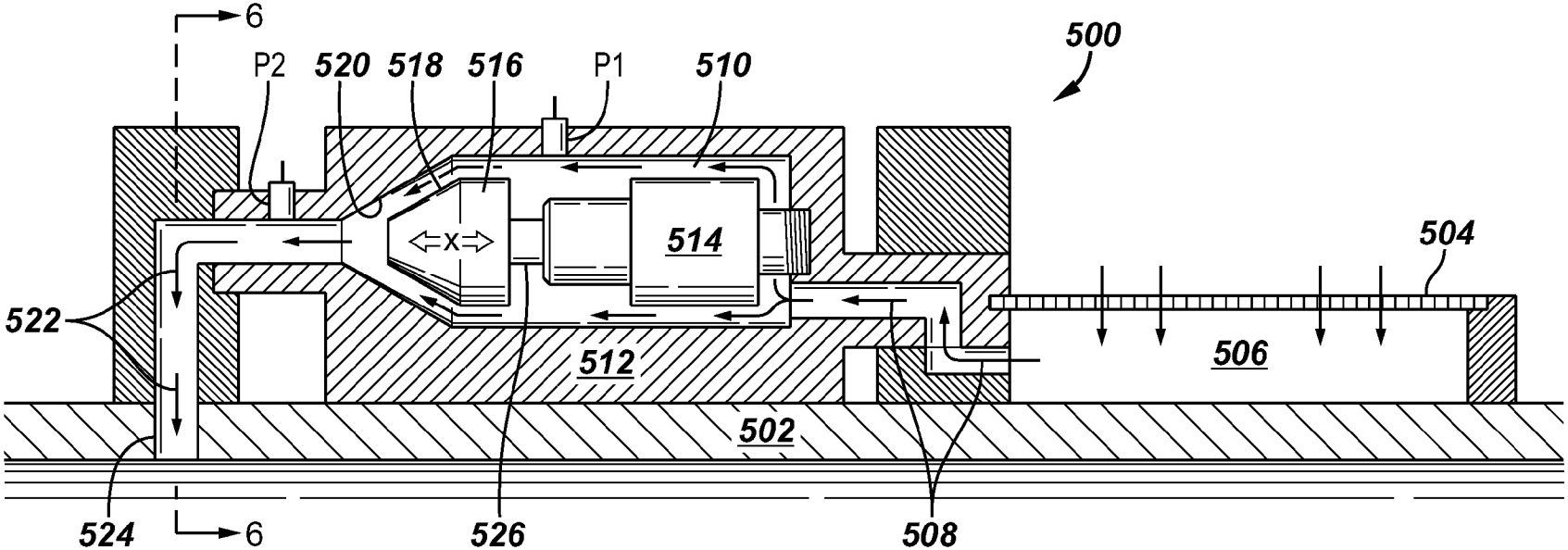
FIGS. 5A-13 illustrate different types of flow control valves, according to some embodiments.
Figure 5B:
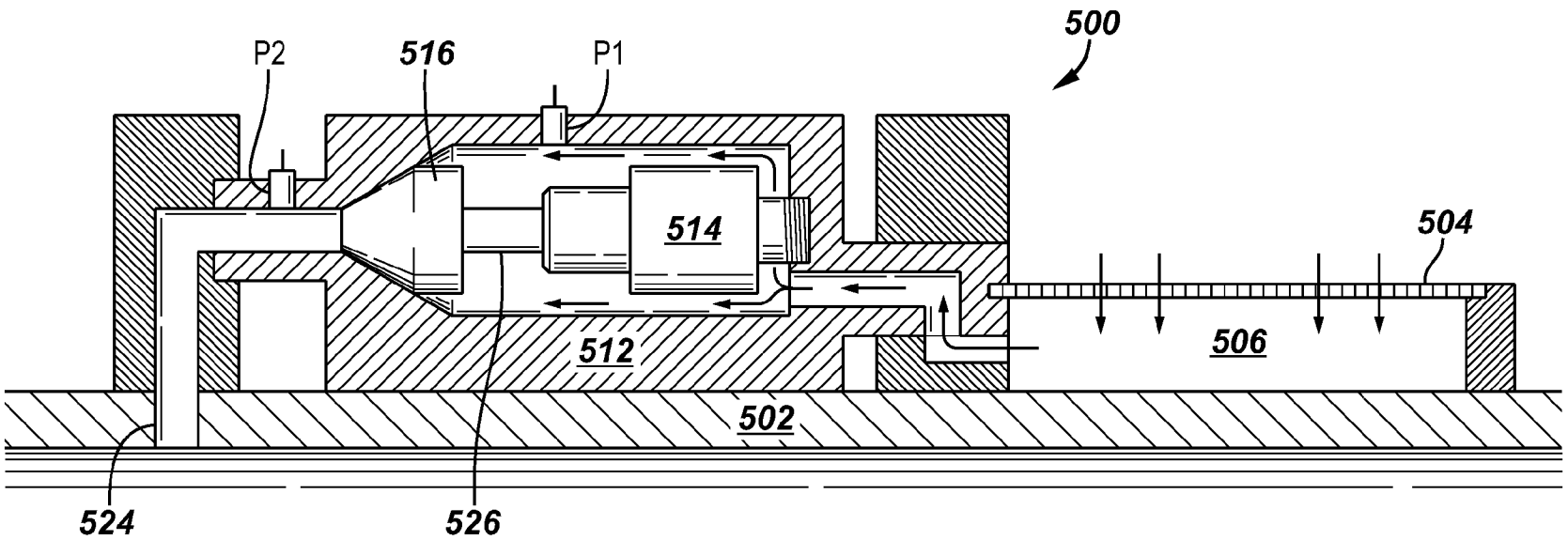

Various designs of adjustable flow control devices are discussed below. FIGS. 5A and 5B show a first embodiment of a variable electric flow control valve 500. The valve 500 can be mounted on a mandrel 502, such as the inner mandrels of the various flow control assemblies discussed above. A screen 504 is provided at an inlet to the valve 500 to provide fluid flow into a space 506 inside the screen 504 at the inlet of the valve 500. The fluid follows inlet path 508 into an inner chamber 510 defined in housing 512 of the flow control valve. The chamber 510 also contains an electric motor 514 that is configured to move a choke member 516 along a longitudinal direction of the flow control valve, indicated by axis x in FIG. 5. The choke member 516 has a sloped engagement surface 518 that is provided to engage corresponding sloped surface 520 in the inner wall of the housing 512. When the sloped surfaces 518 and 520 engage, as depicted in FIG. 5B, a sealing engagement is provided such that flow is stopped through an outlet part 522 of the flow control valve 500.

The flow control valve 500 is in the choked position in FIG. 5A to allow fluid flow arriving at the inlet path 508 to continue through the outlet path 522 and the outlet port 524 to an inner bore of the mandrel 502.

In the closed position, as shown in FIG. 5B, the choke member 516 is engaged against the inner surface 520 of the housing 512 to prevent flow from reaching the outlet path 522.

The choke member 516 is attached to an actuating rod 526 that is movable by the electric motor 514 in the longitudinal direction (x direction) to cause movement of the choke member 518.

Figure 6:
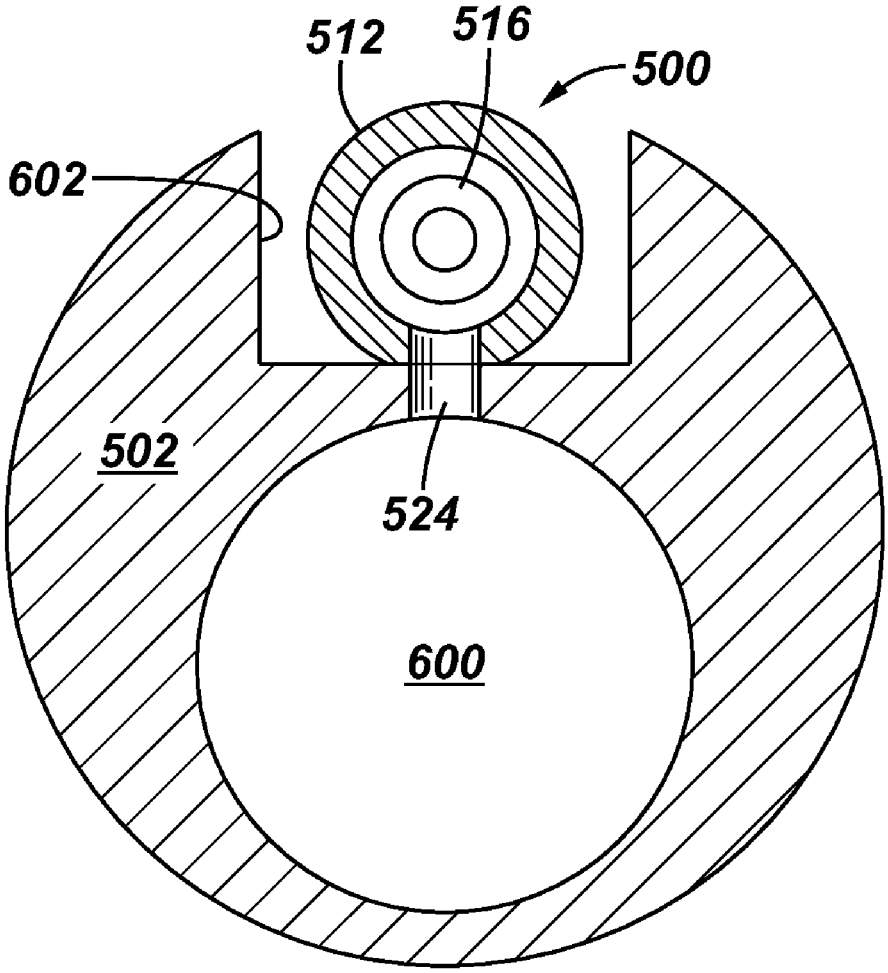

A top view of the flow control valve 500 and the mandrel 502 to which the flow control valve 500 is attached is depicted in FIG. 6. The flow control valve 500 allows for fluid to be communicated through the outlet port 524 of the mandrel 502 into an inner bore 600 of the mandrel 502.

Note that the flow control valve 500 is positioned in a side pocket 602 defined in the outer surface of the mandrel 502. The side pocket runs along a longitudinal direction of the mandrel 502 to allow for the valve 500 to be positioned in the side pocket 602. In the example implementation shown in FIG. 6, the side pocket 602 depicted does not have a cover such that the flow control valve is exposed to the wellbore environment. In another implementation, a cover can be provided to cover the side pocket 602.

FIGS. 5A-5B also show pressure sensors P1 and P2 of the flow control valve 500, with sensor P1 used to measure pressure in the chamber 510, and sensor P2 used to measure pressure in the outlet path 522. The measurement data provided by sensors P1 and P2 allows a well operator to determine a position of the flow control valve 500.

Figure 7:
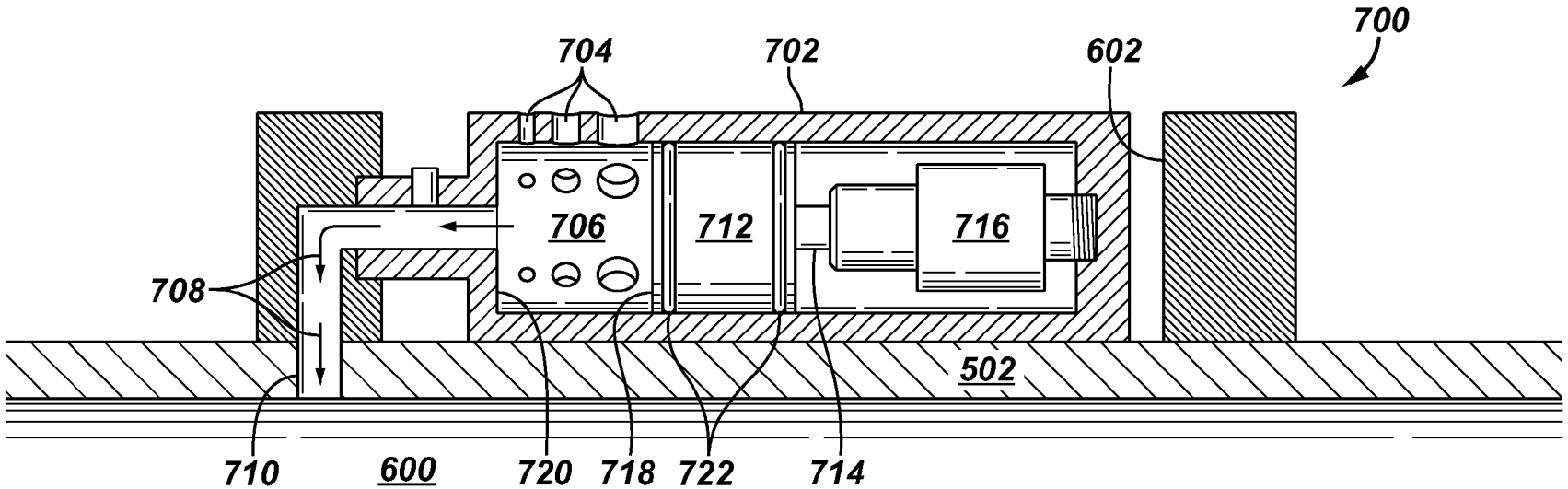

FIG. 7 shows another electric flow control valve 700 that does not use a screen (e.g., screen 504 in FIG. 5A). The flow control valve 700 can also be positioned in the side pocket 602 of the mandrel 502 (FIG. 6). The flow control valve 700 has an outer housing 702 with ports 704 to allow fluid to flow from outside the flow control valve 700 into a space 706 inside the housing 702 (provided a seal member 712 does not block all ports 704). The fluid flows through the space 706 and out along outlet path 708 to an outlet port 710 of the flow control valve 700 to allow flow into the inner bore 600 of the mandrel 502.

The seal member 712 is provided inside the housing 702, where the seal member is attached to an actuating rod 714 that is moveable by an electric motor 716. The electric motor 716 is able to move the sealing member 712 in the longitudinal direction (of the valve 700) to engage an end portion 718 of the sealing member 712 against an end wall 720 inside the housing 718. Once the sealing member 712 and end wall 720 are engaged, seals 722 (e.g., O-ring seals) on the sealing member 712 block fluid flow from entering into chamber 706, since the sealing member 712 completely blocks all ports 704 of the housing 702.

The flow control valve 700 in FIG. 7 is depicted to be in its full open position. When the sealing member 712 is actuated to engage the end wall 720, a fully closed position is provided. The sealing member 712 can also be provided at an intermediate position to selectively block one or more of the ports 704 to provide intermediate choke positions.

Figure 8:
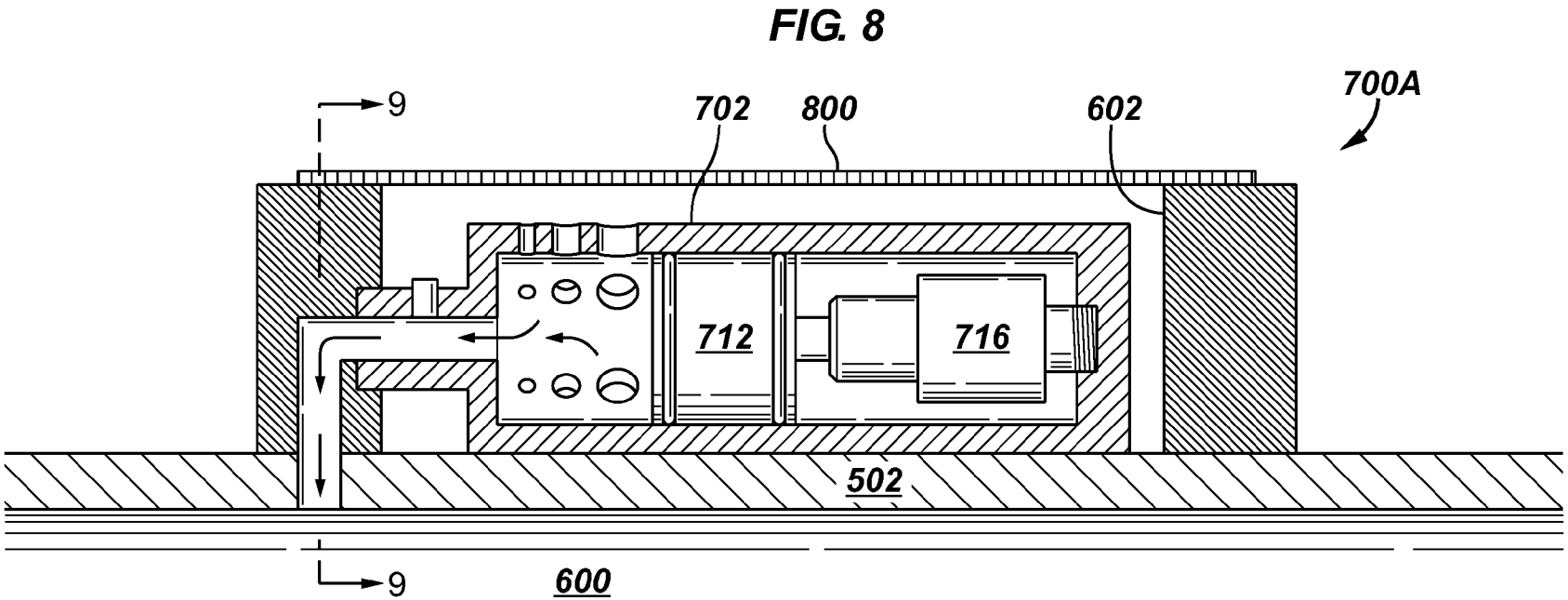

FIG. 8 shows a modified form of the flow control valve of FIG. 7, where the flow control valve of FIG. 8 is referenced as 700A. The difference between the flow control valve 700A and the flow control valve 700 is the provision of a screen 800 in the FIG. 8 embodiment. Otherwise, the flow control valve 700A of FIG. 8 is identical to the flow control valve 700 of FIG. 7.

Figure 9:
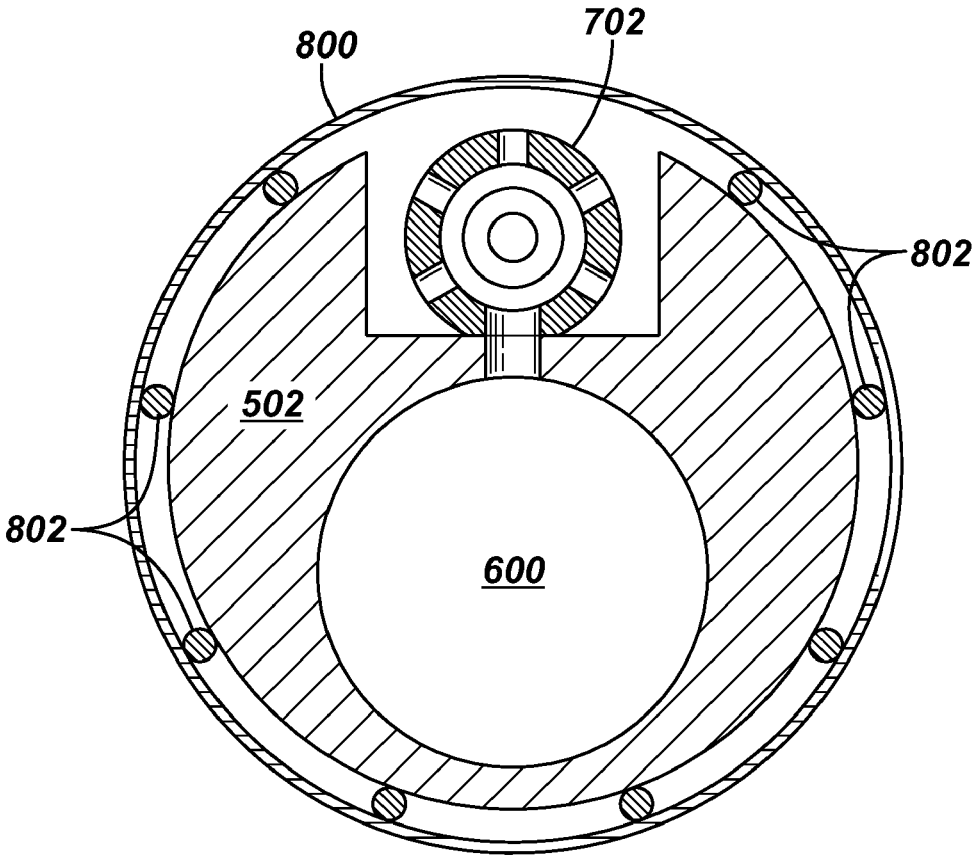

A top view of the flow control valve 700A along section 9-9 of FIG. 8 is depicted in FIG. 9. FIG. 9 shows the screen 800 provided around the mandrel 502, with support members 802 positioned between the screen 800 and the mandrel 502 to support the screen 800 on the mandrel 502.

Figure 10:
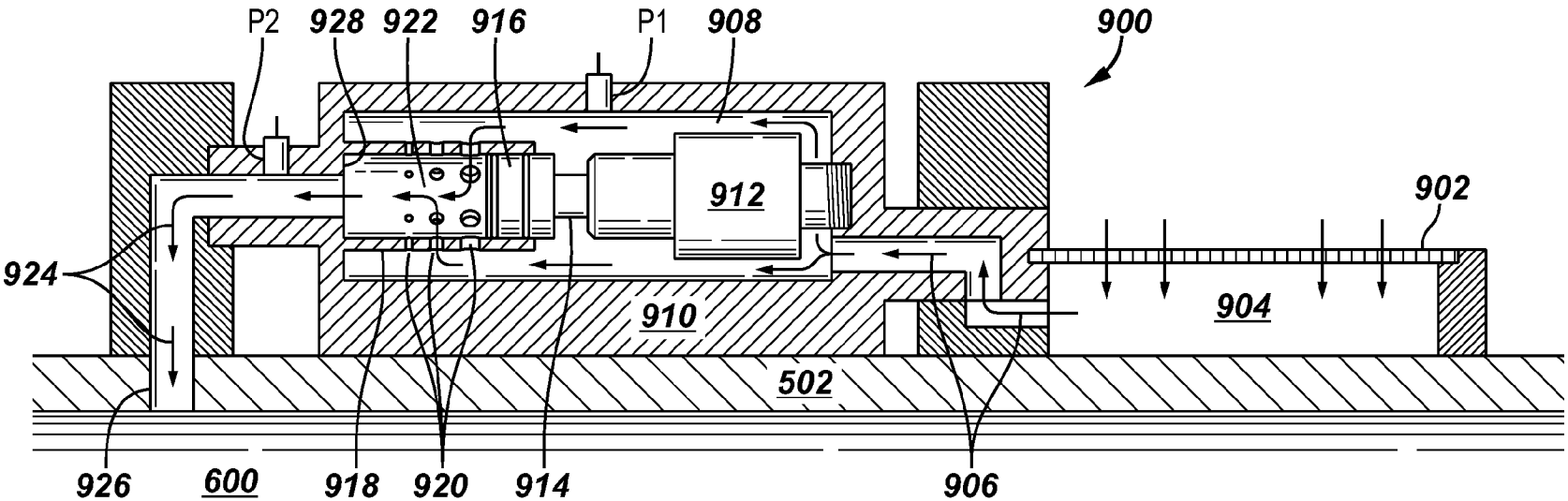

FIG. 10 shows another embodiment of a flow control valve that uses a screen. The FIG. 10 flow control valve 900 has a screen 902 at its inlet to allow fluid to flow from outside the flow control valve 900 through the screen 902 into a space 904. The fluid then flows from the space 904 along inlet path 906 into an inner chamber 908 of a housing 910 of the flow control valve 900. Inside the chamber 908 is an electric motor 912 that is able to move an actuating rod 914. A sealing member 916 is attached to the actuating rod 914 to allow the electric motor 912 to move the sealing member 916 longitudinally (in a longitudinal direction of the flow control valve 900). The fluid flows in the chamber 908 around the electric motor 912 and around an inner shroud 918 also provided in the chamber 908. The inner shroud 918 has radial ports 920 to allow fluid to flow from outside the inner shroud 920 into an inner space 922 of the shroud 918. The fluid that flows into the inner space 922 of the shroud 918 can then follow outlet path 924 to an outlet port 926 into the inner bore 600 of the mandrel 502.

FIG. 10 shows the flow control valve 900 in its open position, in which the sealing member 916 is in a position that allows all flow ports 920 of the shroud 918 to be exposed to allow a full opening into the inner space 922 of the shroud 918. The sealing member 916 is movable toward an end wall 928 of the housing 910 to provide a fully closed position. The sealing member 916 is also positionable to selectively close off ports 920 to provide intermediate choked positions.

The flow control valve 900 of FIG. 10 also has pressure sensors P1 and P2, with sensor P1 measuring pressure within the chamber 908, and sensor P2 measuring pressure in the outlet path 922.

Figure 11A:
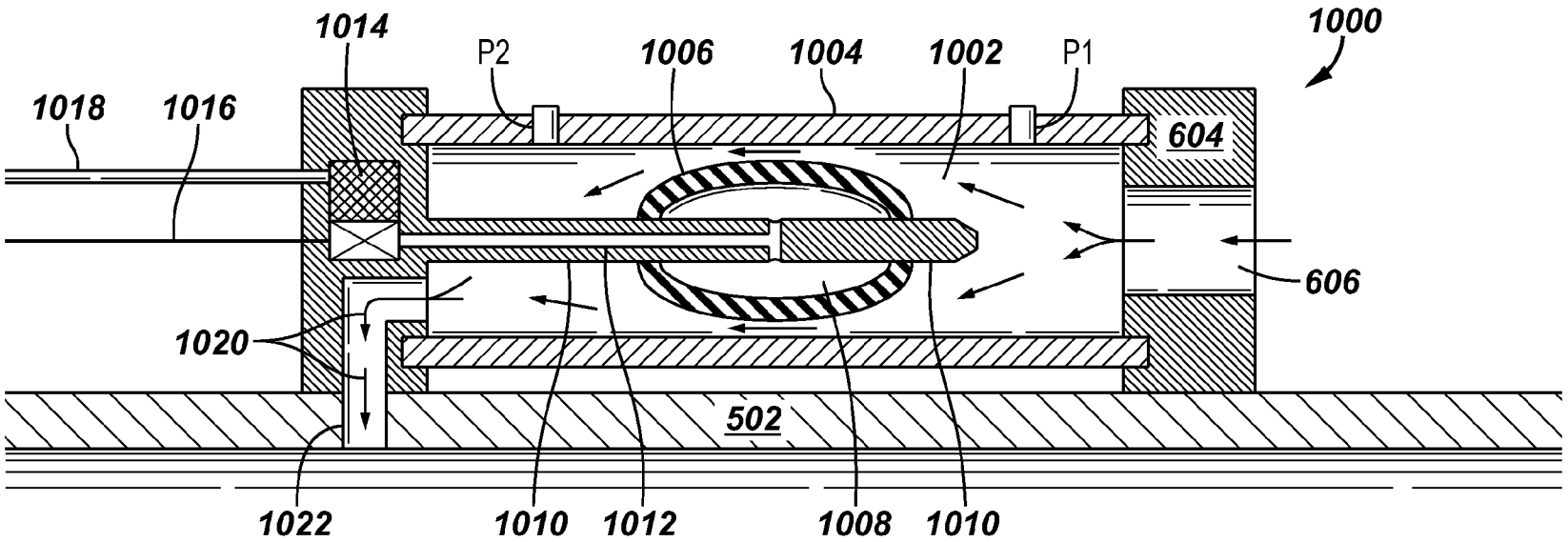
Figure 11B:
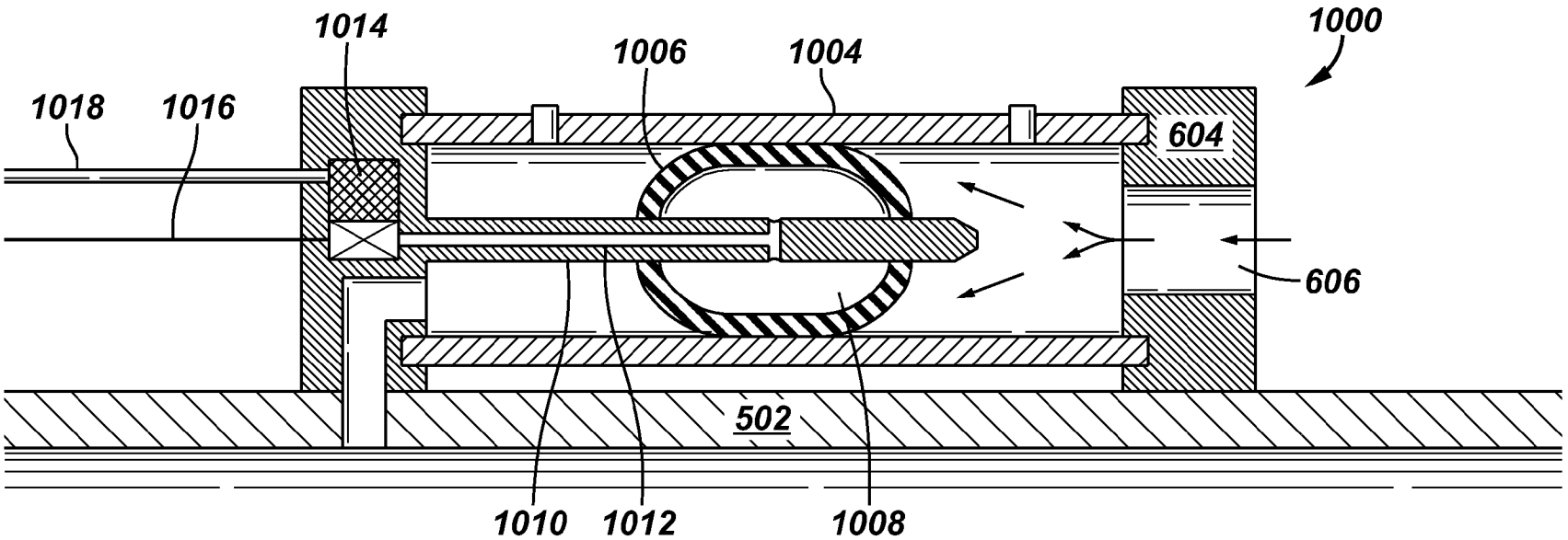
Figure 11C:
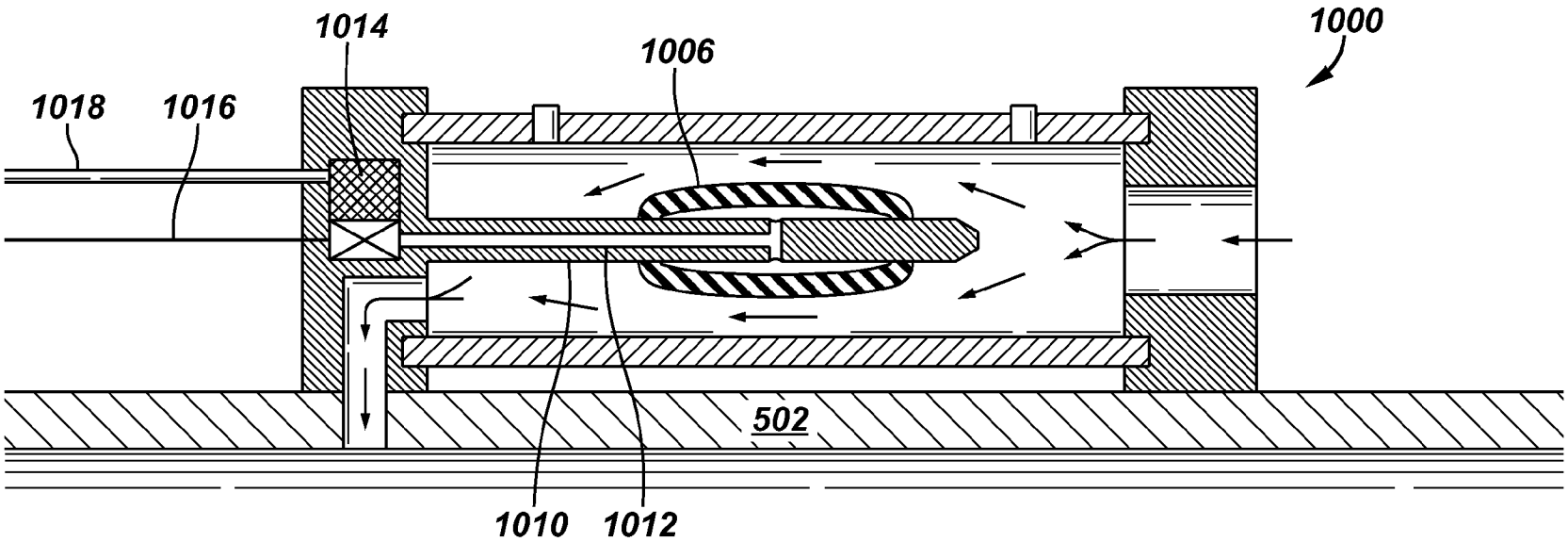

FIGS. 11A-11C illustrate another variation of a flow control valve 1000. The flow control valve 1000 is a hydraulic flow control valve instead of an electric flow control valve as discussed above in connection with FIGS. 5-10. FIG. 11C shows the flow control valve 1000 in its full open position, FIG. 11B shows the flow control valve in its full closed position, and FIG. 11A shows the flow control valve in an intermediate position (choked position).

The mandrel 502 defines a structure 604 that has an inlet port 606 to allow fluid to flow from outside the flow control valve 1000 into an inner chamber 1002 defined inside a housing 1004 of the flow control valve 1000. Within the chamber 1002 of the housing 1004 is an inflatable bladder 1006. The inflatable bladder 1006 has an inner space 1008. The bladder 1006 is arranged on a support member 1010, where a portion of the support member 1010 has an inner fluid control line 1012 to allow communication of hydraulic pressure to the inner space 1008 of the inflatable bladder 1006.

The inner control line 1012 is connected to a control module 1014, which is controlled by an electrical line 1016. The control module 1014 controls the application of hydraulic pressure to the control line 1012, where a source of the hydraulic pressure is provided over a hydraulic control line 1018. The control module 1014 can be controlled to apply hydraulic pressure from the hydraulic control line 1018 to the inner control line 1012 to cause hydraulic pressure to be communicated to the inner space 1008, which causes the inflatable bladder 1006 to inflate. FIG. 11A shows the bladder 1006 inflated to an intermediate position.

In the intermediate position of FIG. 11A, fluid flowing through the inlet port 606 is able to flow around the outside of the inflatable bladder 1006 to an outlet path 1020 to exit outlet port 1022.

FIG. 11C shows the inflatable bladder 1006 in its fully retracted position to maximize fluid flow past the inflatable bladder 1006. On the other hand, FIG. 11B shows the bladder 1006 fully inflated such that the inflatable bladder 1006 engages the inner wall of the housing 1004. This blocks flow coming through the inlet port 606 from reaching the outlet path 1020.

As depicted in FIG. 11A, pressure sensors 1024 and 1026 can be provided to monitor pressure on the two sides of the inflatable bladder 1006. A pressure difference between the pressure sensors 1024 and 1026 (which can provide pressure data P1 and P2, respectively) would indicate that the inflatable bladder 1006 is fully inflated to the closed position.

The flow control valve 1000 also has pressure sensors P1 and P2, which are used to measure pressure on two sides of the chamber 1002 inside the flow control valve housing 1004.

Figure 12A:
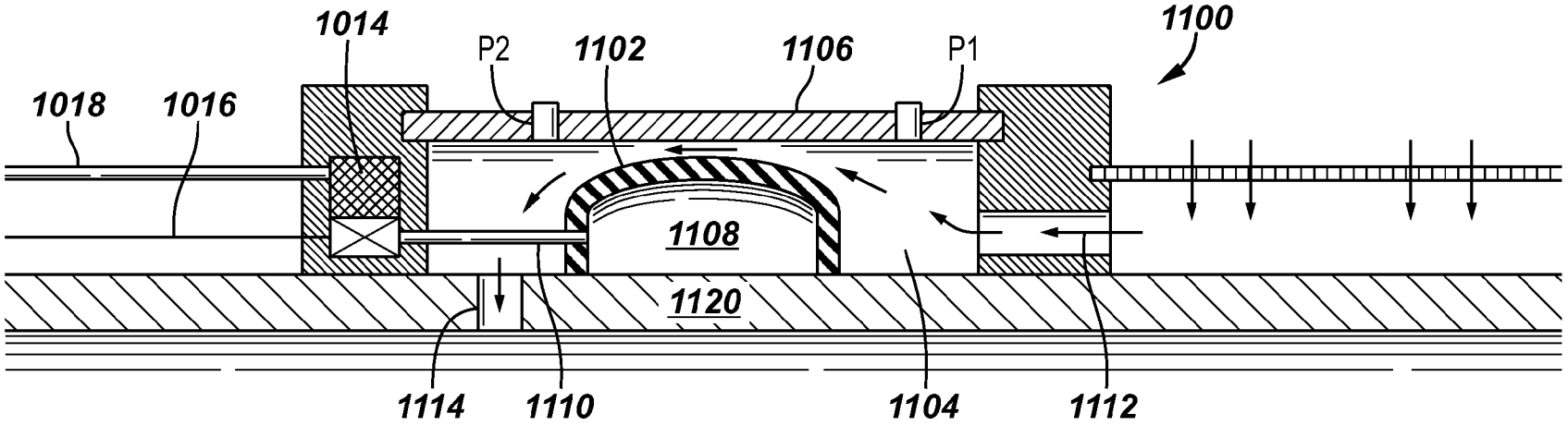
Figure 12B:
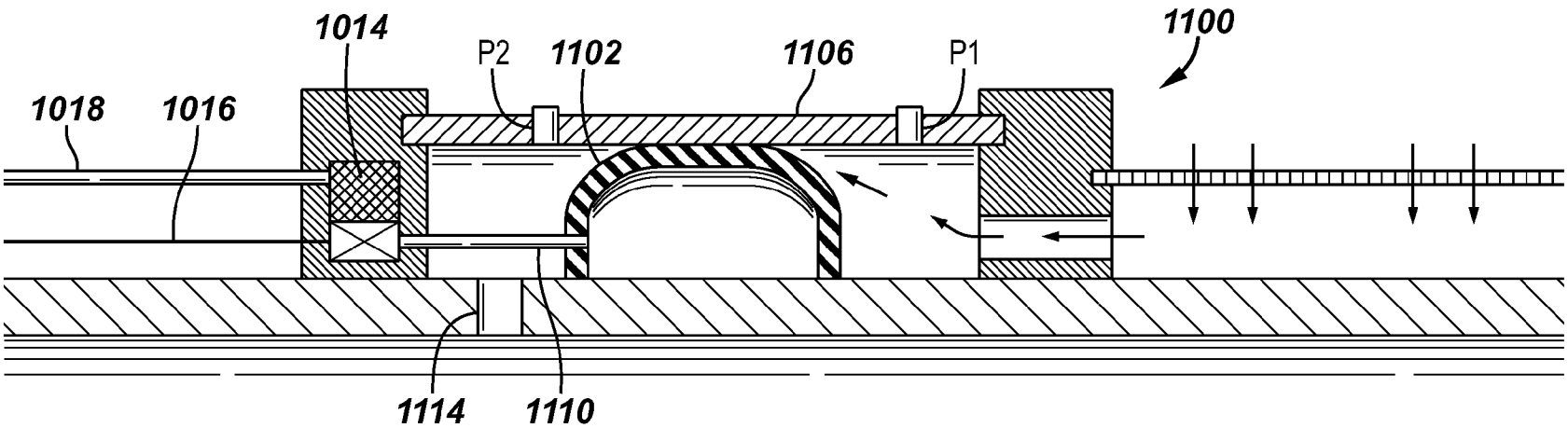
Figure 12C:
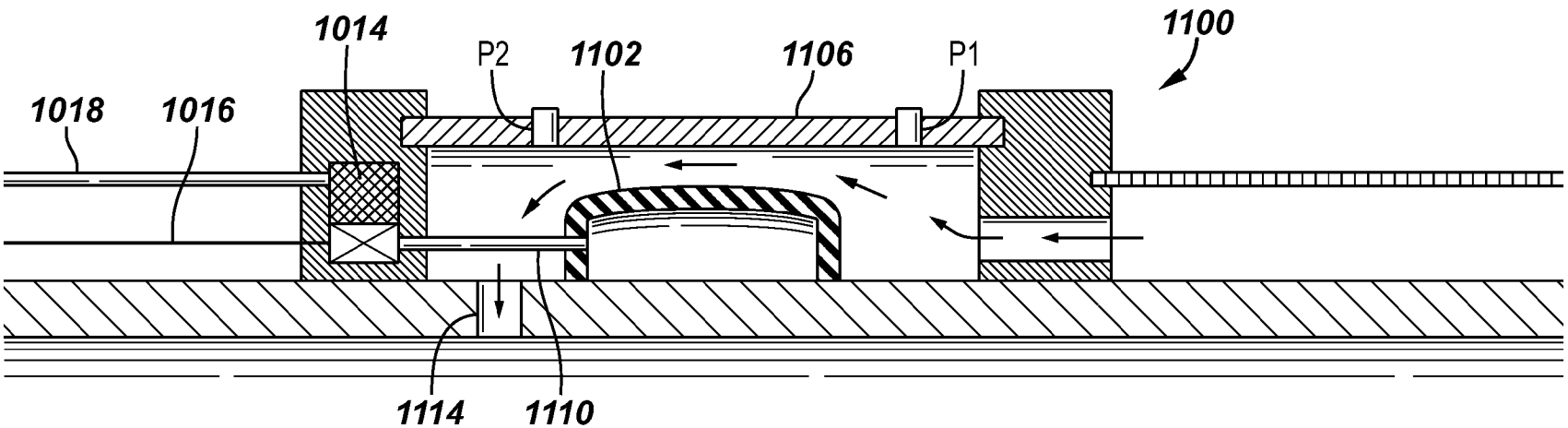
Figure 13:
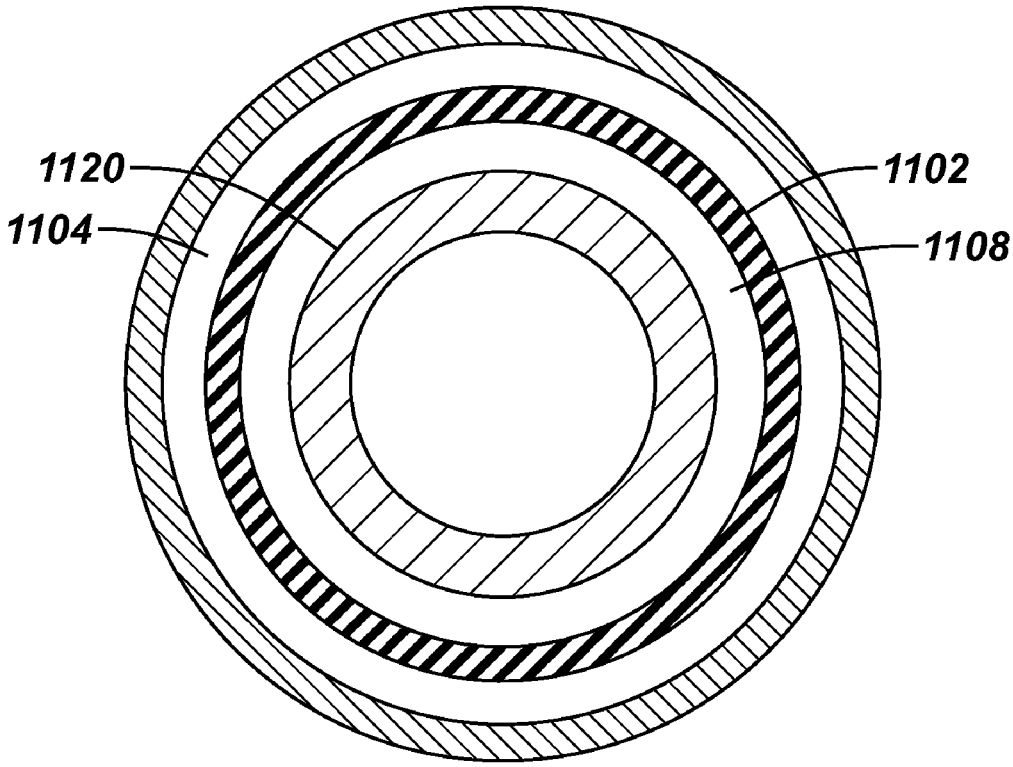

The flow control valve 1000 can also be provided in the side pocket of the mandrel 502 much like the electric flow control valve 500 depicted in FIG. 6. In a different embodiment, instead of providing a flow control valve in a side pocket, the flow control valve can be made to extend around the full circumference of the mandrel. This is depicted in FIGS. 12A-12C and FIG. 13. FIGS. 12A-12C depict a hydraulic flow control valve 1100 that has an inflatable bladder 1102 positioned inside an annular chamber 1104 of a housing 1106 of the flow control valve 1100. The bladder 1102 extends around the outer circumference of an inner mandrel 1120. The bladder 1102 has an inner space 1108 that is in communication with a control line 1110. The control line 1110 is connected to the control module 1014 that is controllable by the electric line 1016. The control module 1014 is able to apply hydraulic pressure from hydraulic control line 1018 to the inner space 1108 of the bladder 1102.

FIG. 12A shows the flow control valve 1100 in its choked position, FIG. 12B shows the flow control valve 1100 in its closed position, and FIG. 12C shows the flow control valve 1100 in its fully open position. Fluid flows through an inlet port 1112 to the inner chamber 1104 of the housing 1106. In the choked position and open position of FIGS. 12A and 12C, respectively, fluid can flow around the outside of the inflatable bladder 1102 to the outlet port 1114 that is provided on the inner mandrel 1120. In the closed position, as depicted in FIG. 12B, fluid flow is blocked between the inlet port 1112 and the outlet port 1114.

Figure 14:
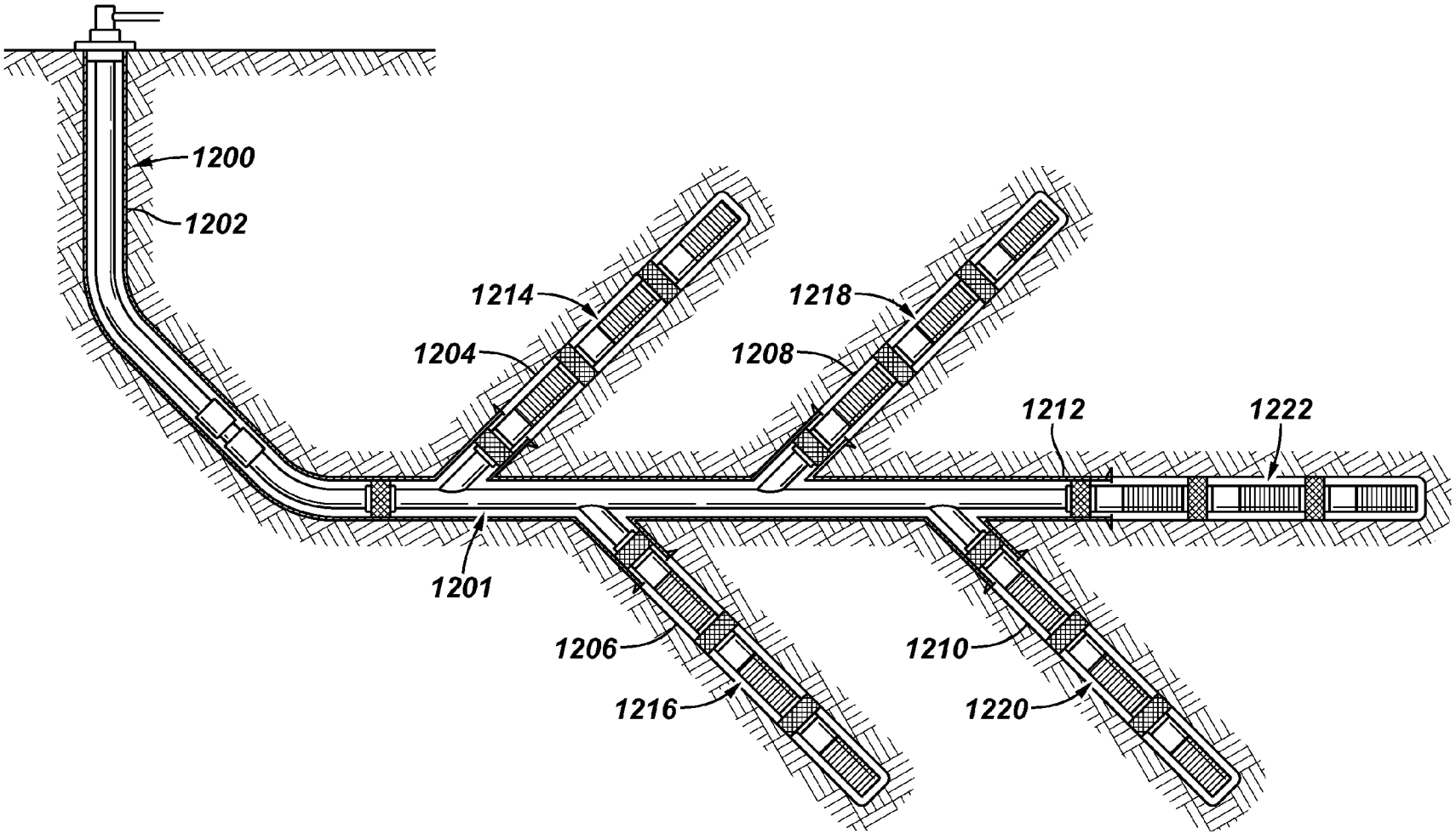
FIGS. 14-22 illustrate various stages of providing completion equipment in a multilateral well, according to an embodiment.

FIG. 14 shows a multilateral well 1200 that has a main wellbore 1202 and multiple lateral branches 1204, 1206, 1208, and 1210. Also, a lower section 1212 is provided at the end of the main wellbore 1202.

Within each of the lateral branches 1204, 1206, 1208, and 1210, and within the end section 1212 are provided completion assemblies that are similar to the assemblies discussed above in connection with FIGS. 1-4. Completion assembly 1214 is provided in lateral branch 1204, completion assembly 1216 is provided in lateral branch 1206, completion assembly 1218 is provided in lateral branch 1208, completion assembly 1220 is provided in lateral branch 1210, and completion assembly 1222 is provided in the lower wellbore section 1212. Also depicted in FIG. 14 is a main completion assembly 1201 that extends through portions of the main wellbore 1202 adjacent corresponding lateral completion assemblies 1214, 1216, 1218, and 1220, and connects to the completion assembly 1222 in the lower completion section 1212. This is contrasted to conventional completion systems that include separate main completion segments stacked in the main wellbore 1202, where each main completion segment is separately coupled to a respective lateral completion assembly. In such a conventional system, the main completion segments are run in separately and sequentially after each corresponding lateral completion assembly is deployed, with the separately run main completion segments stacked as they are run into the main wellbore. In contrast, the main completion assembly 1201 of FIG. 14 is deployed as a continuous string through the main wellbore 1202 and past the lateral completion assemblies to the lower completion assembly 1222. The main completion assembly 1201 is able to communicate fluids with the lateral branch bores, and communicate electrically with the lateral completion assemblies.

Figure 15:
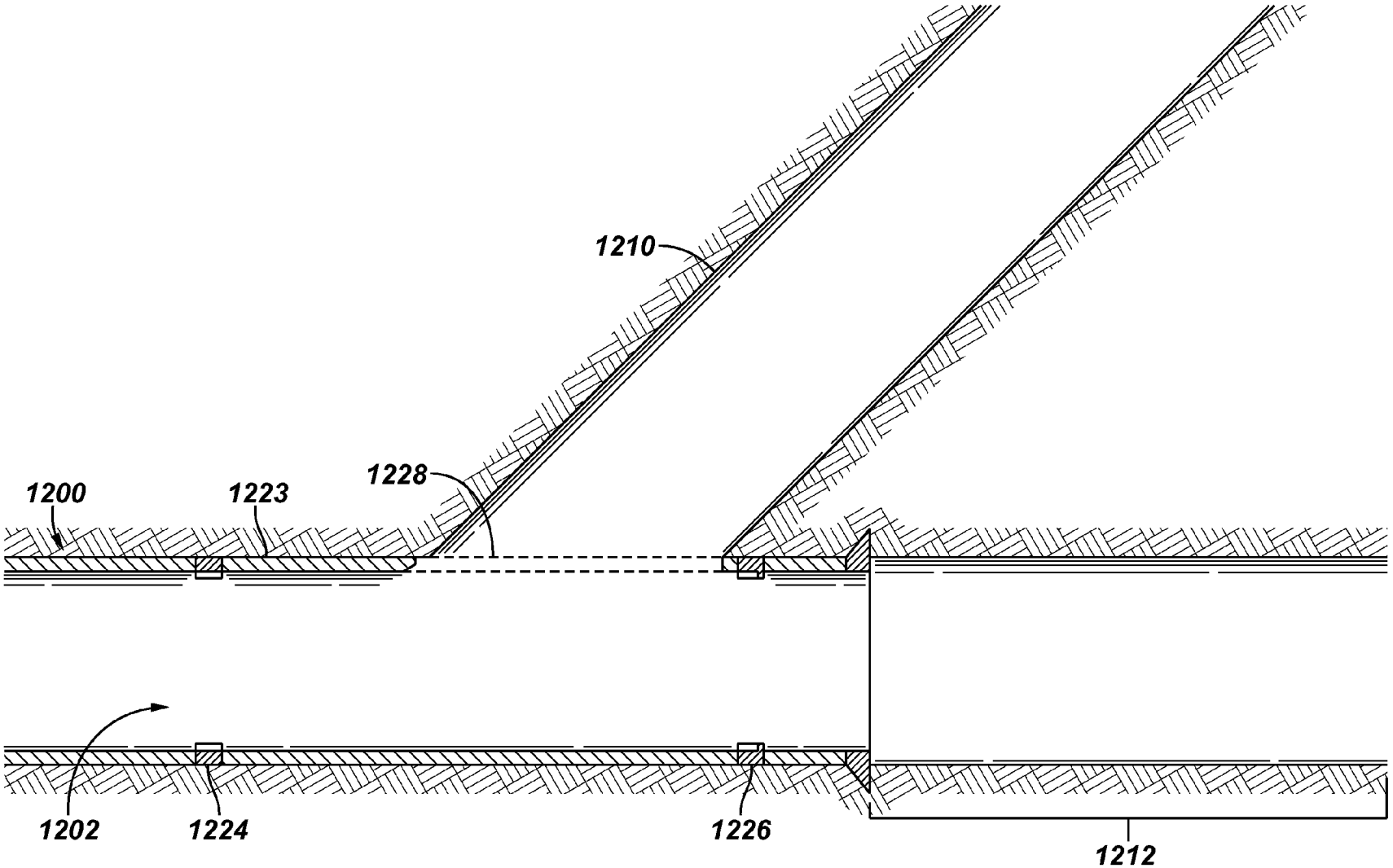

The following figures describe various stages of completing one of the lateral branches of the multilateral well 1200. As depicted in FIG. 15, focus is made on lateral branch 1210, for example.

The main wellbore section 1202 of the multilateral well 1200 is lined with casing 1223. A first index casing coupling 1224 is provided in a lower position of the casing 1223, where the index casing coupling 1224 is located in the main wellbore 1202 before the lateral branch 1210. A second index casing coupling 1226 is provided past the lateral branch 1210. The index casing couplings 1224 and 1226 are aligned azimuthally so that subsequent completion equipment can be properly oriented with respect to the lateral branch 1210. The second (lower) index casing coupling 1226 is used to azimuthally position a deflector (described below) to orient a tool (e.g., drilling tool) toward the lateral branch. The second (upper) index casing coupling 1224 is aligned with the lower index casing coupling 1226 to orient deployment of various equipment, as discussed further below. The casing 1223 has a pre-milled window 1228 to allow for communication between the inside of the casing 1223 and the lateral branch 1204.

After running the casing or liner 1200 in the main bore, drilling of the multilateral branch through pre-milled windows 1228 as shown in FIG. 15 is performed. All the multilateral branches are drilled before running completion.

Figure 16:
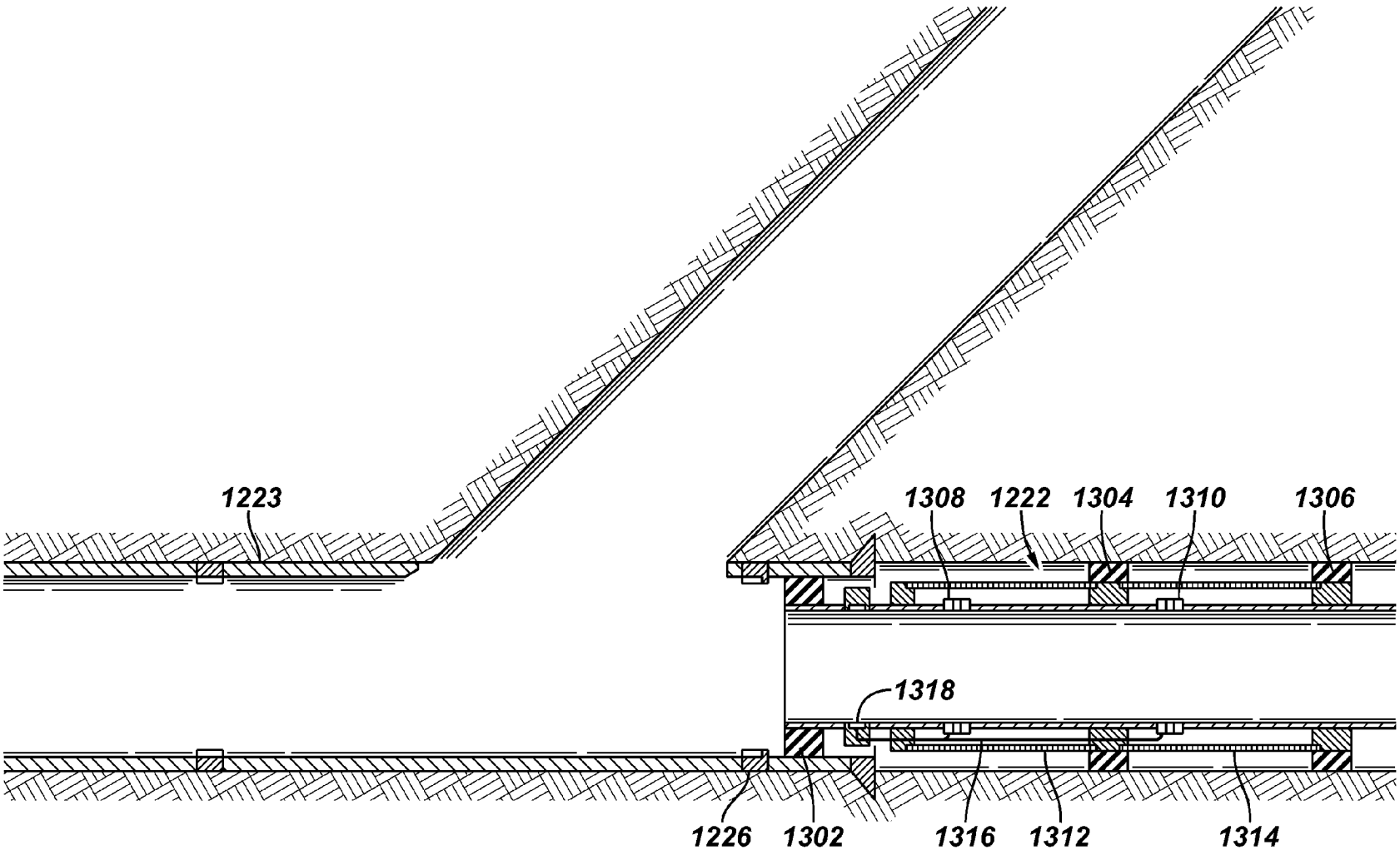

FIG. 16 shows deployment of the completion system 1222 in the lower section 1212 of the main wellbore 1202. The completion assembly 1222 has packers 1302, 1304, and 1306 to define multiple zones. Also, the completion assembly 1300 has adjustable flow control valves 1308 and 1310 in the two respective zones. Screens 1312 and 1314 are provided in the two zones for sand control. The adjustable flow control valves 1308 and 1310 can be any of the flow control valves in FIGS. 5A-13.

An electric cable 1316 is provided to control the adjustable flow control valves 1308 and 1310. The electrical cable 1316 is electrically connected to a first (e.g., female) inductive coupler portion 1318. The female inductive coupler portion 1318 is used to mate with another (e.g., male) inductive coupler portion (discussed below) to allow for electrical energy to be provided to the electrical cable 1316 for the purpose of controlling the adjustable flow control valves 1308 and 1310.

Figure 17:
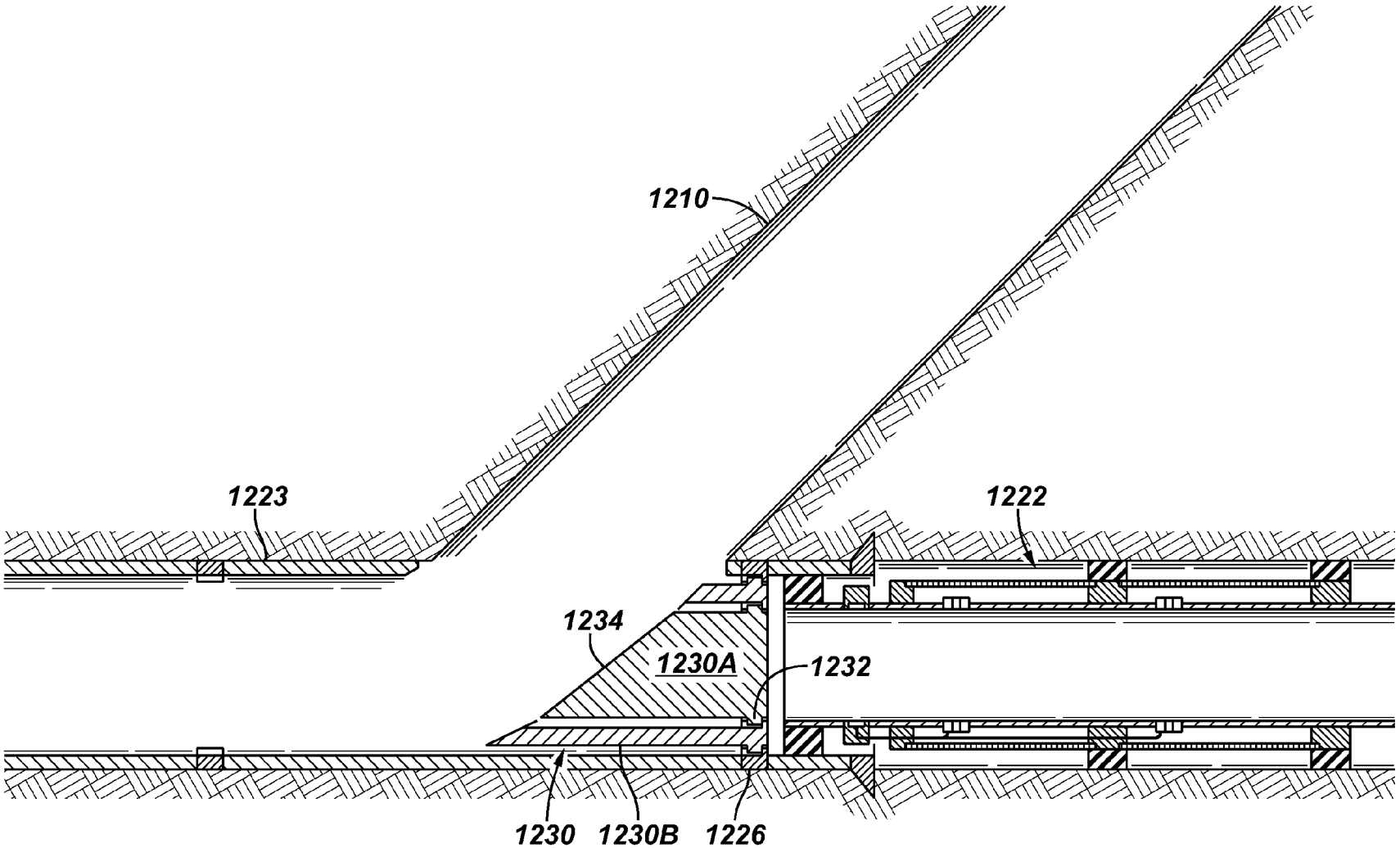

FIG. 16 shows deployment of a completion assembly in the main wellbore, in this case the lower section 1212 of the main wellbore. Next, the lateral branch 1210 is completed by deploying the completion assembly 1220 (FIG. 14) in the lateral branch 1210. To perform such deployment, as depicted in FIG. 17, a two-part deflector 1230 is run to a location of the second indexing casing coupling 1226 so that the deflector 1230 engages the indexing casing coupling 1226. The two-part deflector 1230 has a retrievable part 1230A, and a non-retrieved part 1230B that stays in the wellbore after retrieval of the retrievable part 1230A from the wellbore. The deflector 1230 has a mating indexing member 1232 for engaging the indexing casing coupling 1226 to properly position and orient (azimuthally) the deflector 1230 in the wellbore. The proper azimuthal orientation of the deflector 1230 means that the inclined surface 1234 of the deflector 1230 is aligned with the lateral branch 1210. As a result, any subsequent equipment lowered into the casing 1223 will be directed into the lateral branch 1210.

Figure 18:
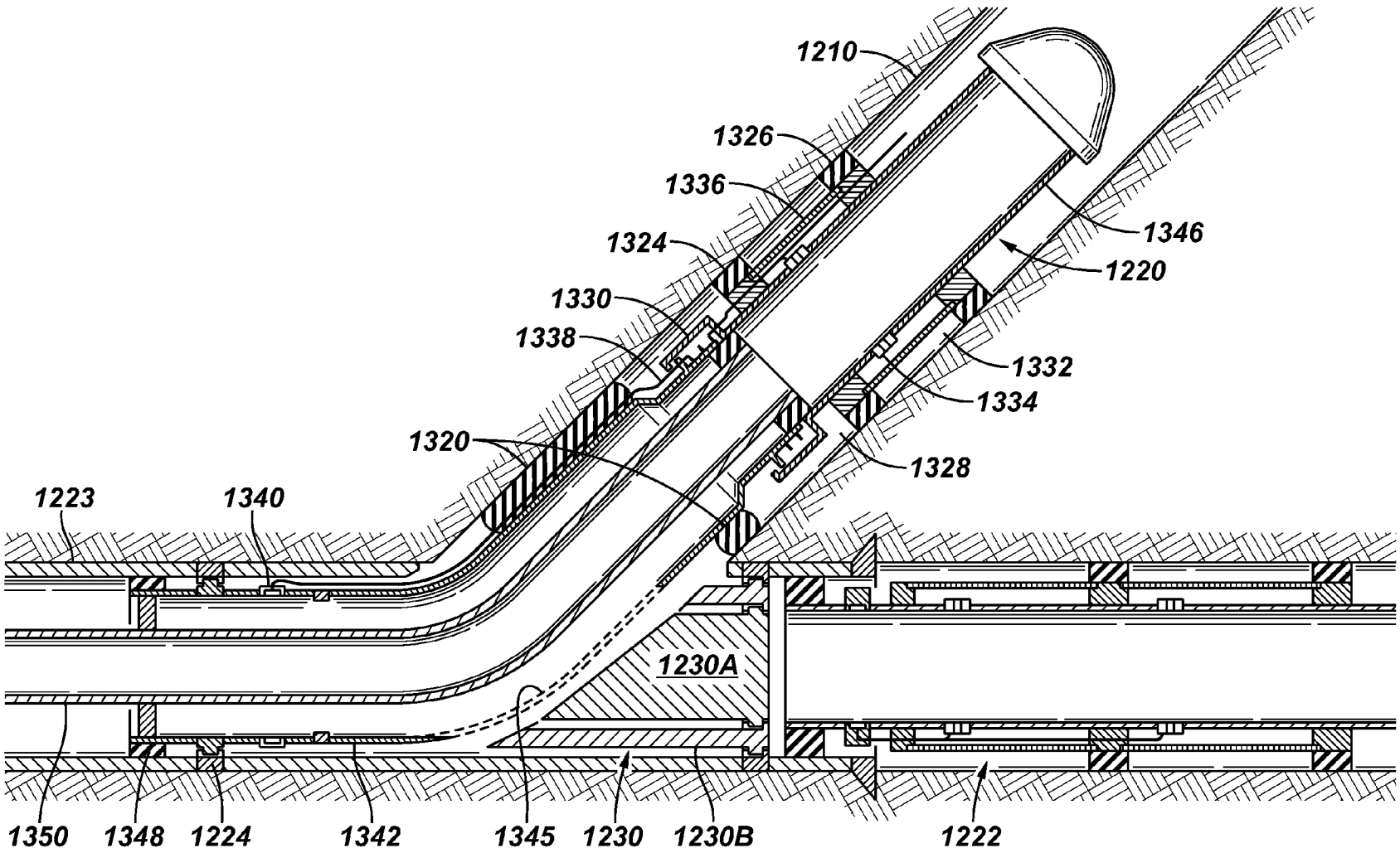

The provision of completion equipment into the lateral branch 1210 is depicted in FIG. 18, which shows completion assembly 1220 provided into the lateral branch 1210. The completion assembly 1220 has packers 1320, 1324, and 1326 to define two zones. The packer 1320 can be made of a swellable material (such as swellable rubber) to swell at the junction to provide the desired seal. Alternatively, the isolation packer 1320 can be a compression-based isolation packer.

A first zone 1328 defined by packers 1320 and 1324 includes a swivel 1330. A second zone 1332 defined by isolation packers 1324 and 1326 includes an adjustable flow control valve 1334 and a screen 1336. The flow control valve 1334 is electrically connected to a electrical line 1338 that passes through the swivel 1330 and through the isolation packers 1324 and 1320 to a third inductive coupler portion 1340 (which can be a female inductive coupler portion). The inductive coupler portion 1340 is attached to a connector housing 1342 that is engaged to the first indexing casing coupling 1224 for proper positioning and orientation of the pre-milled window 1345 in the connector housing or liner 1342 with the bore of the main bore completion. The connector housing 1342 has a pre-milled window 1345—to allow for retrieving the retrievable deflector 1230A after running the completion in the lateral branch. Properly oriented window 1345 in the housing 1342 allows passing the main bore completion through the window 1345. The connector housing 1342 extends from the main wellbore to the lateral branch 1210.

In some embodiments, the connector housing 1342 (also referred to as a junction liner) is run together with lateral completion equipment. As depicted, the junction liner 1342 is engageable with the upper index casing coupling 1224. Since the upper index casing coupling 1224 is azimuthally aligned with the lower index casing coupling 1226, engagement of the junction liner 1342 with the upper index casing coupling 1224 allows for the window 1345 of the junction liner 1342 to line up with the lower part of the main wellbore.

The lower end of the connector housing 1342 is attached to the swivel 1330. The swivel is in turn connected to a pipe section 1346 that extends into the lateral branch 1210. The swivel 1330 allows the junction liner 1342 to freely rotate in relation to the lateral branch completion 1346 to allow for proper alignment of window 1345 in the junction liner installed in the lateral branch and the main wellbore equipment. The swivel is not allowed to rotate while running in the hole. It is unlocked and allowed to rotate once the completion is close to the indexing coupling 1224.

The upper end of the connector housing 1342 is attached to a liner packer 1348, which when set seals against the casing 1223. A work string 1350 is provided through the connector housing 1342 for running of the lateral completion.

Figure 19A:
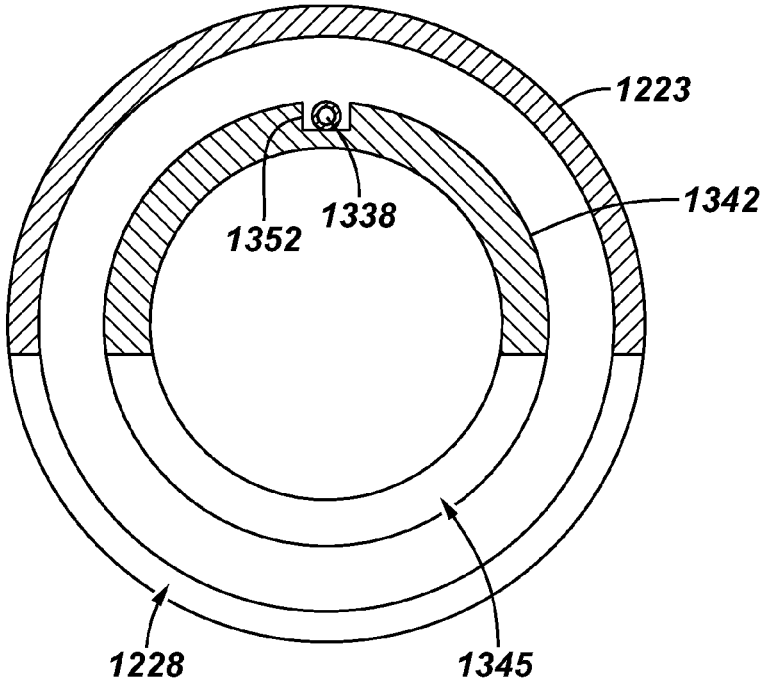

FIG. 19A is a cross-sectional view of a section of the completion system depicted in FIG. 18. As depicted in FIG. 19A, a longitudinal groove 1352 is provided in the connector housing 1342 to run the electrical cable 1338, according to some embodiments. The connector housing 1342 has a pre-milled window 1345. Moreover, the casing 1223 has a pre-milled window 1228.

Figure 19B:
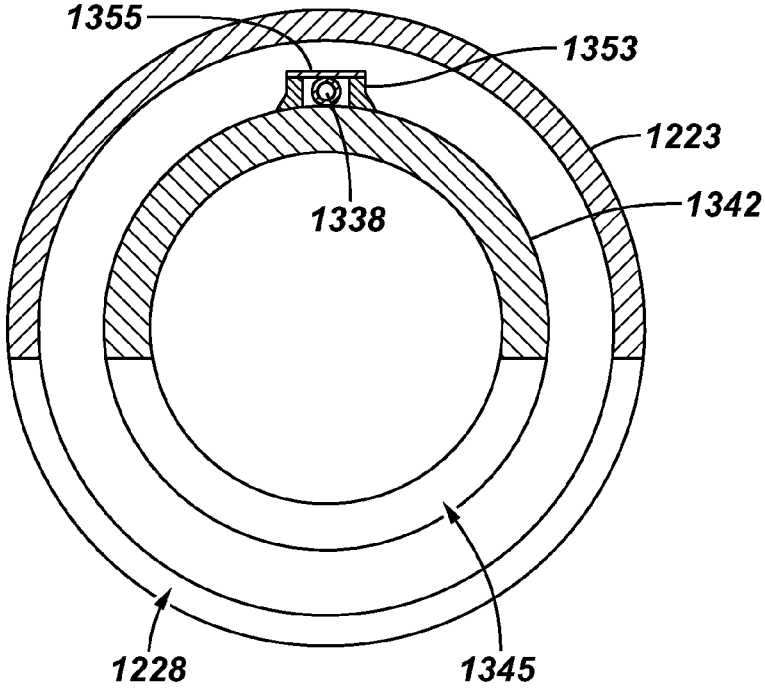

As depicted in FIG. 19B, instead of providing the groove 1352 (FIG. 19A) in the connector housing 1342, rails 1353 can be provided instead, where the rails 1353 run along the length of the connector housing 1342. In one embodiment, the rails 1353 can be welded to the outer surface of the connector housing 1342. Other attachment mechanisms can also be used in other implementations. Also, a cover 1355 can be used to cover the cable 1338 that runs between the rails 1353.

Figure 19C:
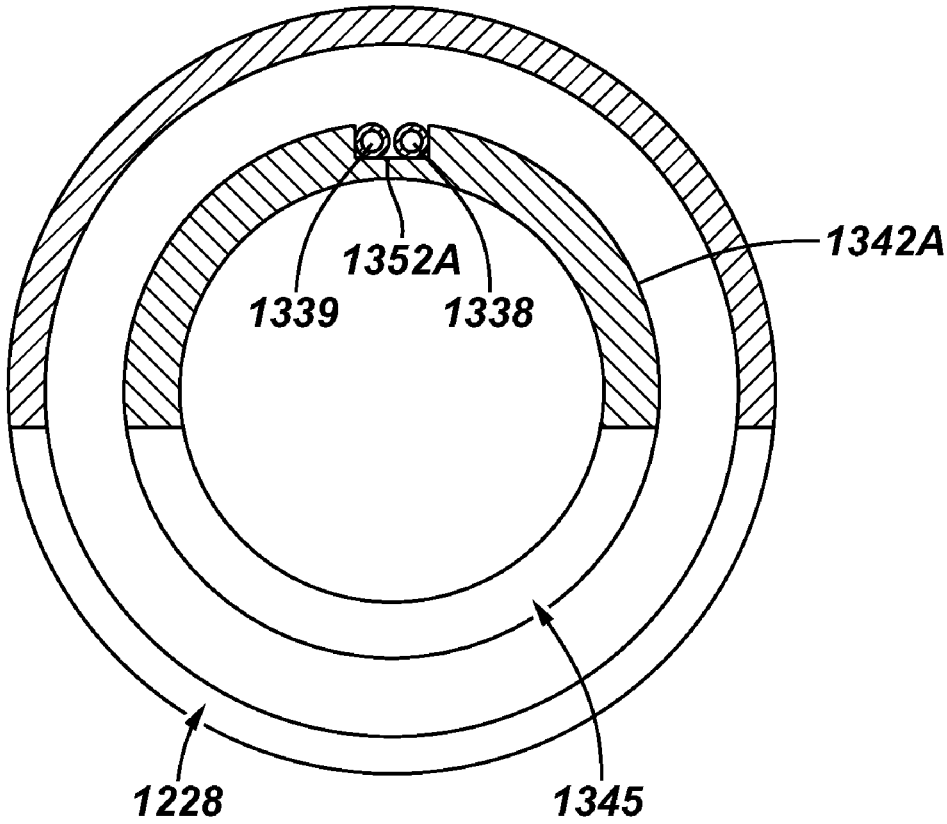

FIG. 19C shows yet another embodiment in which a groove 1352A formed in a connector housing 1342A is enlarged to allow for the provision of both the electrical cable 1338 as well as a hydraulic control line 1339, which can be used to control hydraulic components in various completion assemblies.

Figure 20:
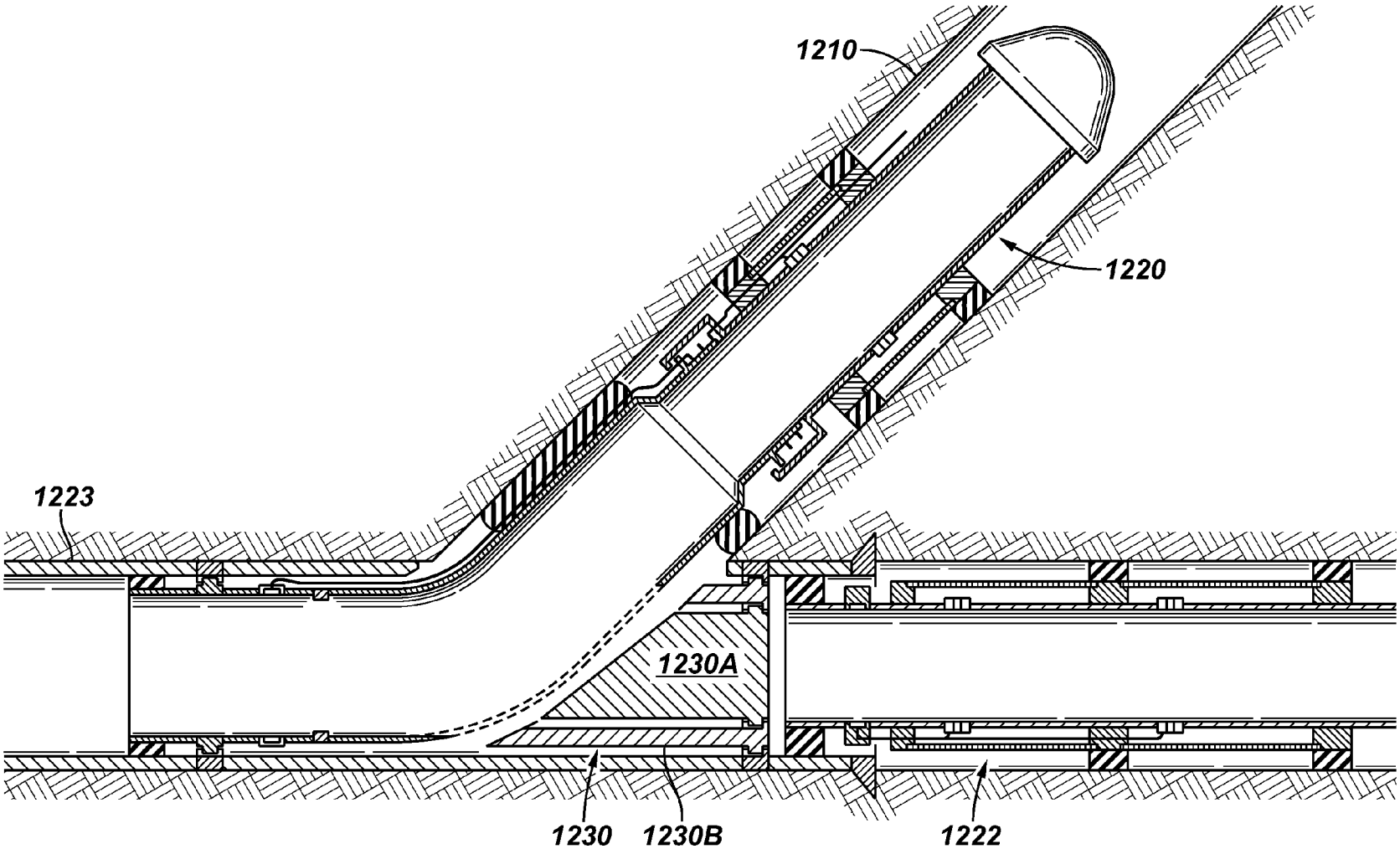
Figure 21:
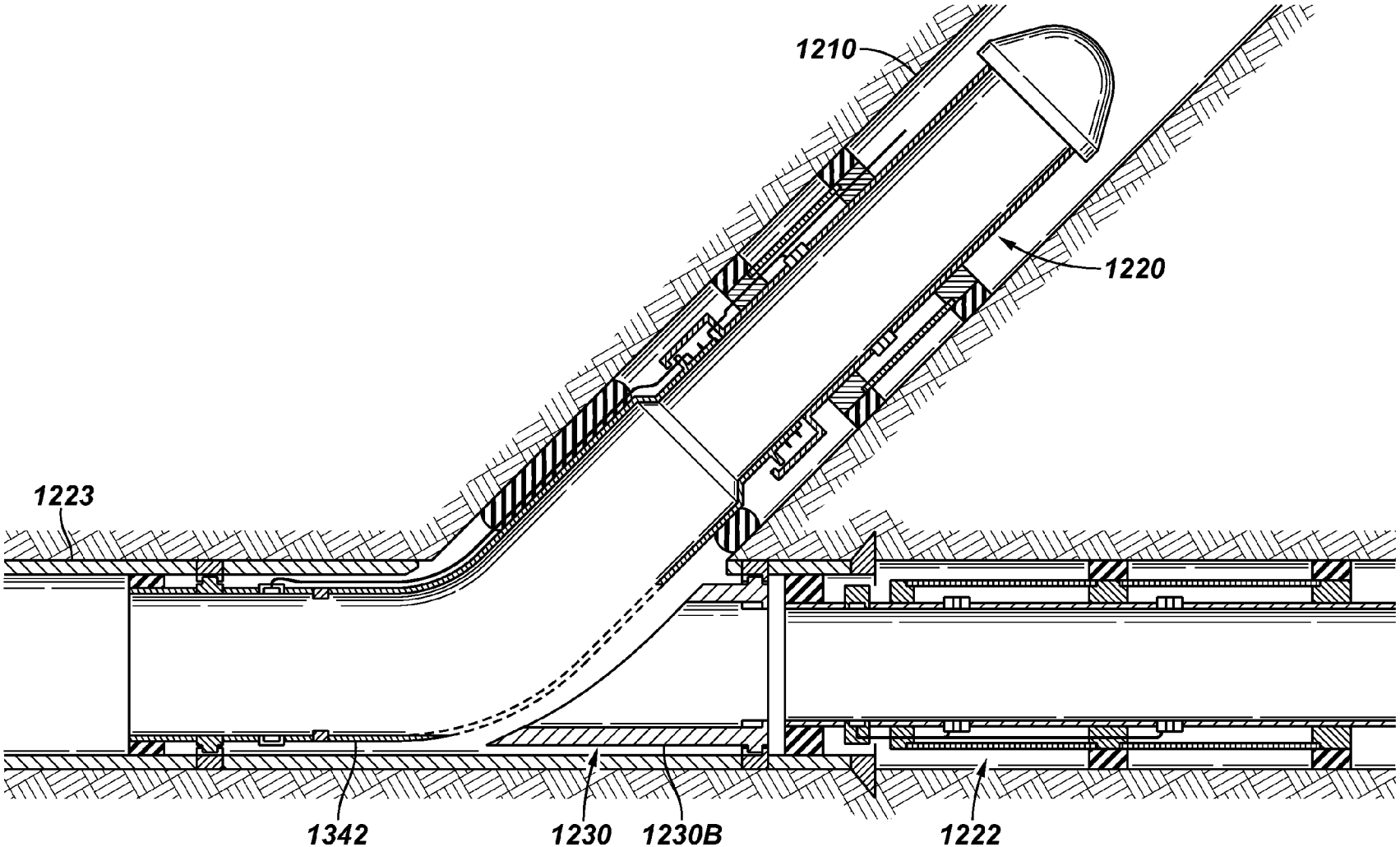
Figure 22:
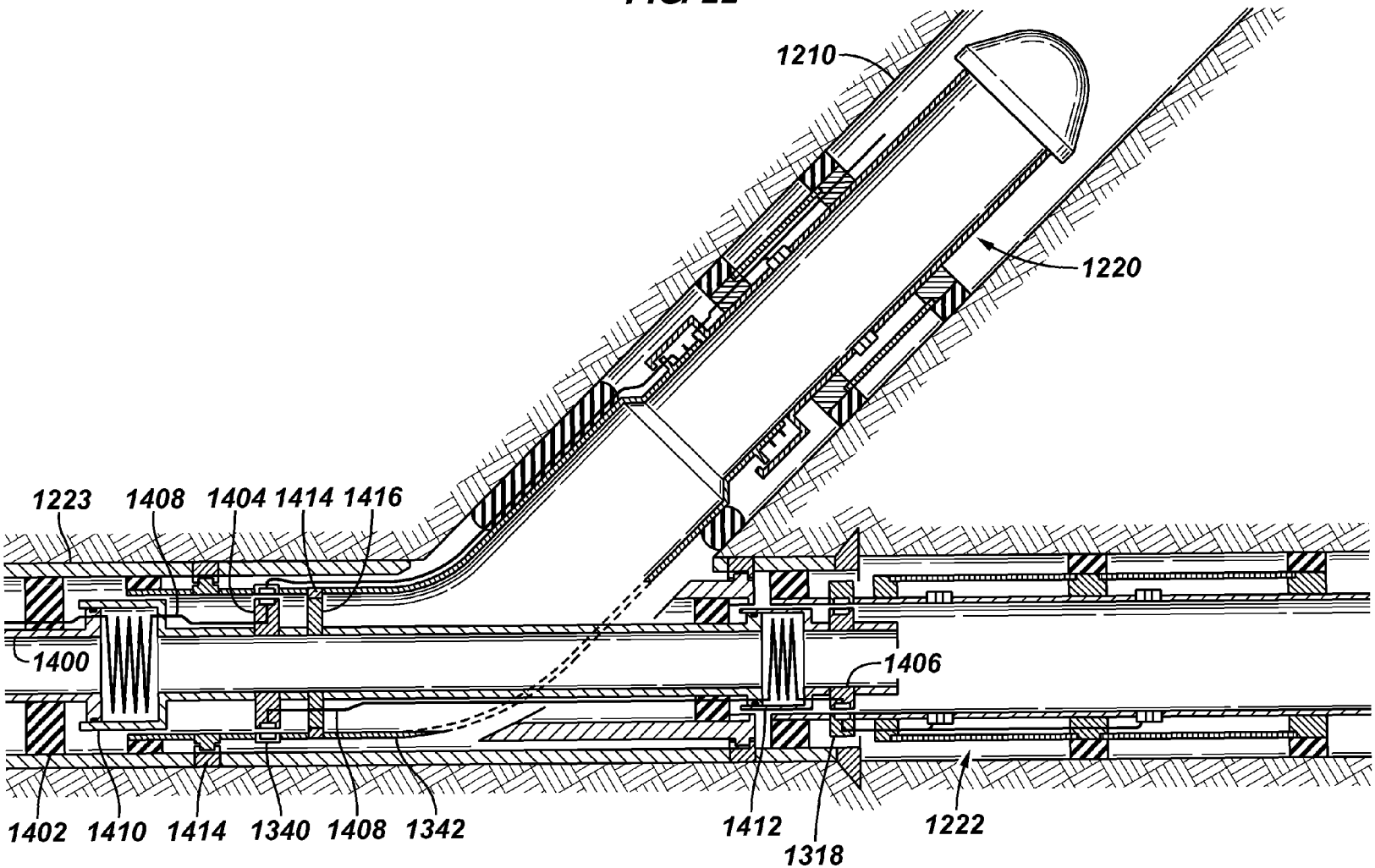

Once the completion assembly 1220 has been set in the lateral branch 1210, the work string 1350 is pulled out of the wellbore to result in the configuration depicted in FIG. 20. Next, the retrievable part 1230A of the deflector 1230 is retrieved from the wellbore, as depicted in FIG. 21. After retrieval of the retrieved part 1230A, the non-retrieved (or permanent) part 1230B remains in the wellbore. After the deflector has been retrieved, the main completion assembly (1201 in FIG. 14) is run into the main wellbore, as depicted in FIG. 22. The main completion assembly 1201 includes completion tubing 1400 and a completion packer 1402 that is set between the tubing 1400 and the casing 1223. The completion tubing 1400 has a first male inductive coupler portion 1404 and a second male inductive coupler portion 1406 for positioning adjacent female inductive coupler portions 1340 and 1318, respectively. An electrical cable 1408 that is run along the completion tubing 1400 extends through the completion packer 1402 and a length compensation joint 1410 to the first male inductive coupler portion 1404. The electrical cable 1408 further extends from the first male inductive coupler portion 1404 through another length compensation joint 1412 to the second male inductive coupler portion 1406. The first set of inductive coupler portions 1404 and 1340 provide a first inductive coupler, and the second set of inductive coupler portions 1406 and 1318 provide a second inductive coupler. The first inductive coupler provides communication of electrical signaling to the completion assembly 1220 in the lateral branch 1210. The second inductive coupler provides electrical communication to the completion assembly 1222 in the lower main wellbore section 1212.

To properly align the inductive coupler portions 1404, 1406 with respective inductive coupler portions 1340 and 1318, a selective locator 1414 is provided. The selective locator 1414 can be provided on the connector housing 1342. A mating selective locator 1416 is provided on the outside of the completion tubing 1400 such that when the selective locators 1414 and 1416 mate, that is an indication that the inductive coupler portions are properly aligned.

Figure 23:
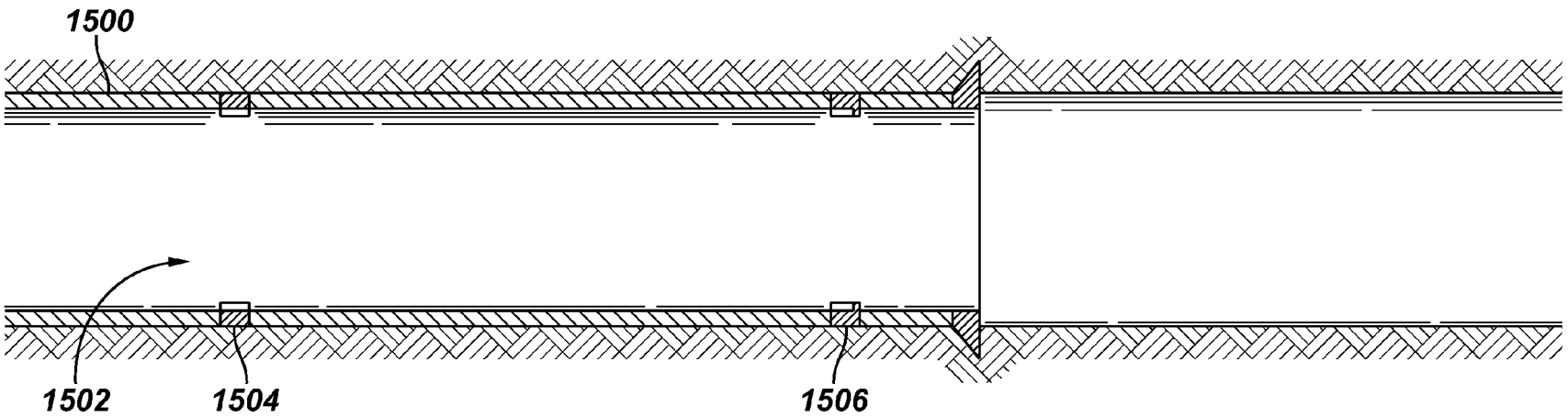
FIGS. 23-25 illustrate stages of providing completion equipment in a multilateral well, according to another embodiment.

The discussion of FIGS. 14-22 assume a casing that has been pre-milled with a window to allow communication with the lateral branch. In contrast, as depicted in FIG. 23, a casing 1500 without a pre-milled window is installed in a main wellbore 1502. The casing 1500 has first and second index casing couplings 1504 and 1506 intended to be provided on either side of the lateral branch when it is milled.

Figure 24:
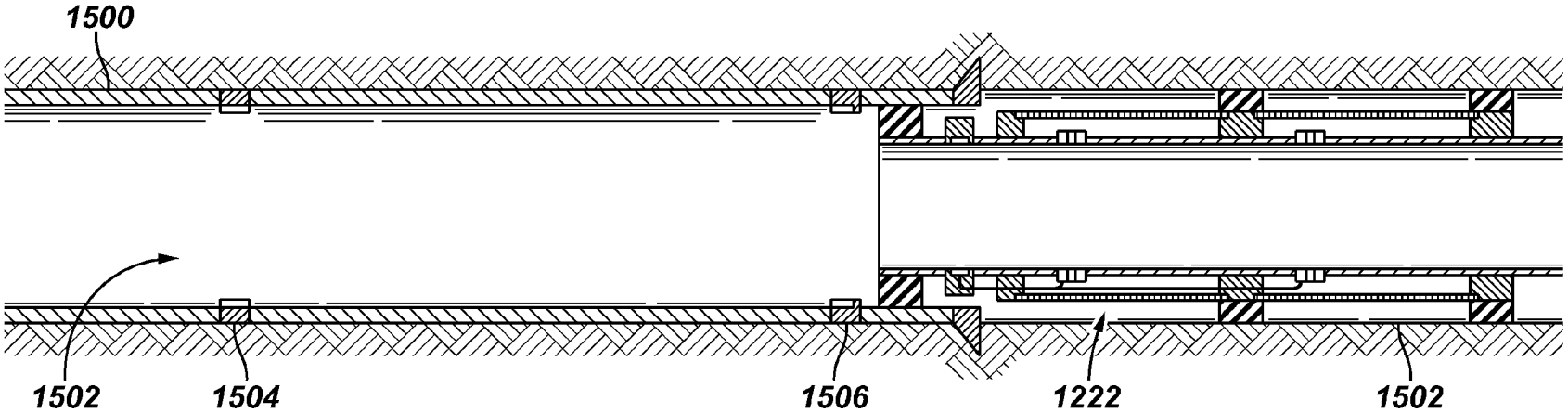
Figure 25:
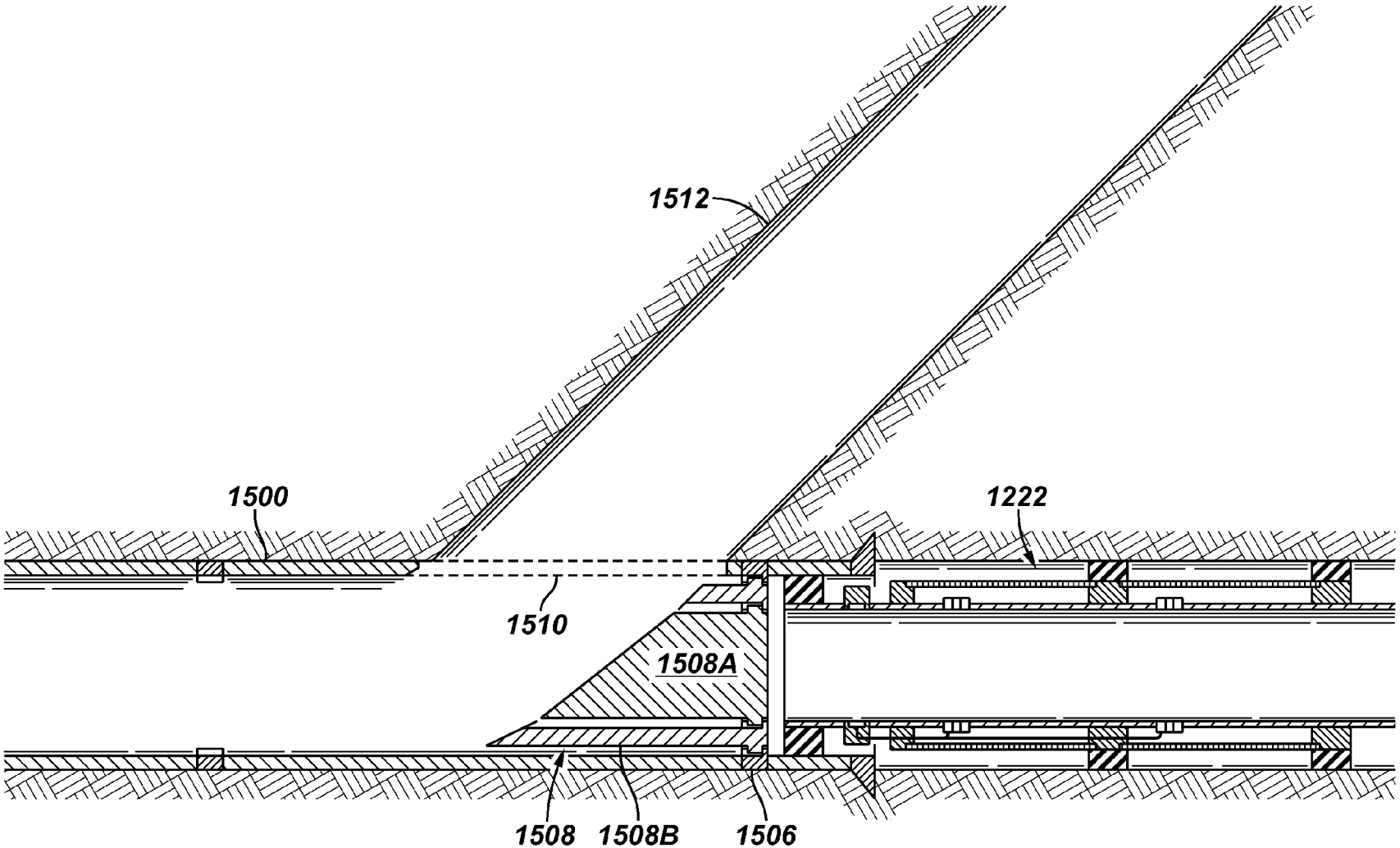

As depicted in FIG. 24, the completion assembly 1222 is installed in the lower section 1212 of the main wellbore 1502. Next, as shown in FIG. 25, a two-part defector 1508 (having a retrievable part 1508A and a permanent part 1508B) is run into the wellbore and engaged with the indexing casing coupling 1506 to position and orient the deflector 1508. Following deployment of the deflector 1508, a lateral window 1510 is milled in the casing 1500, and a lateral branch 1512 is drilled through the milled lateral window 1510. The remaining tasks are similar to the tasks of FIGS. 18-22 discussed above.

Figure 26:
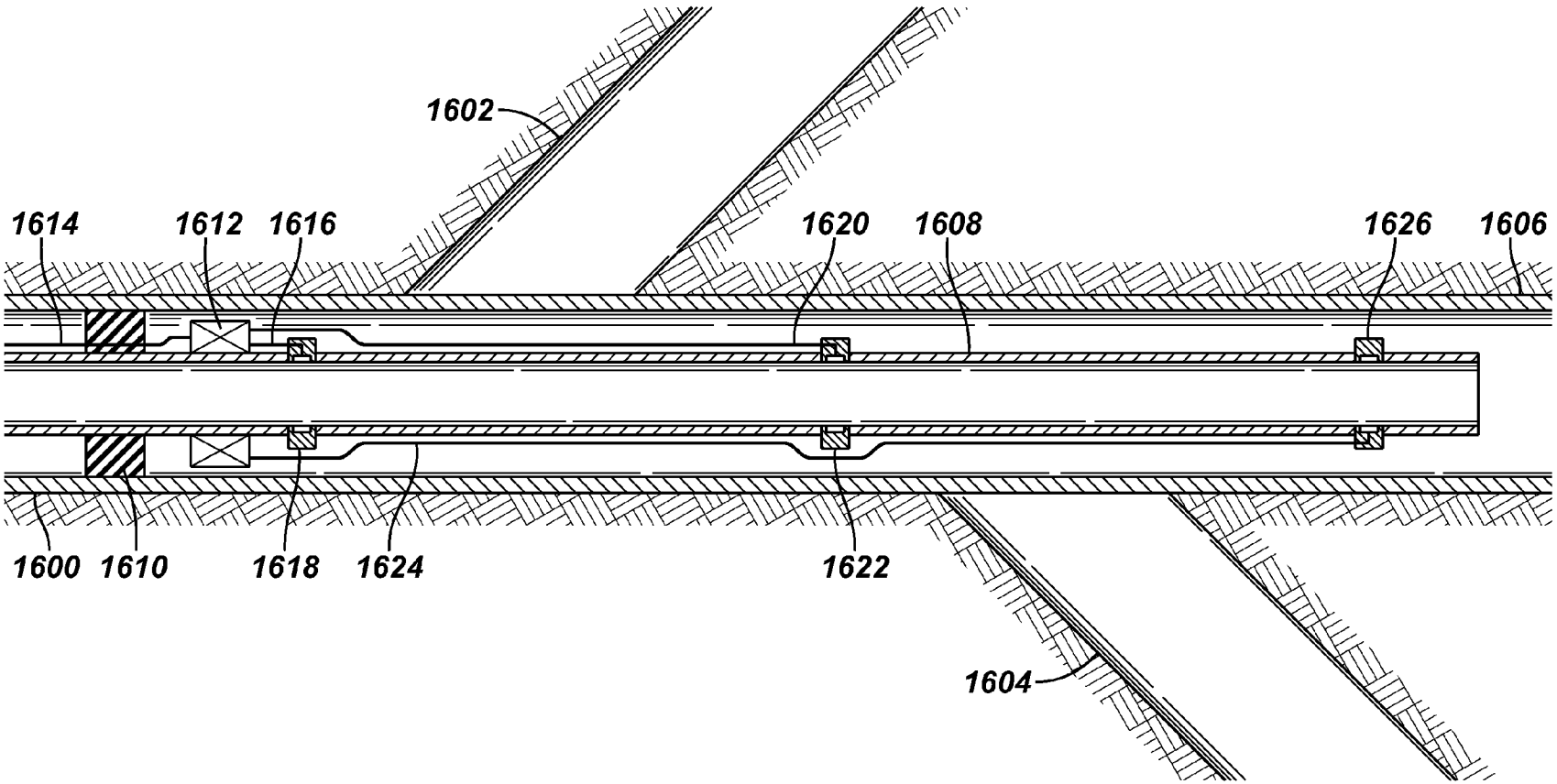
FIGS. 26-27 illustrate different schemes for power and data communications, according to some embodiments.

An alternative communications arrangement is depicted in FIG. 26 to allow for communication with lateral branches 1602, 1604, and a lower section 1606 of a main wellbore 1600. It is assumed that a completion tubing 1608 has been positioned in the main wellbore 1600. A packer 1610 on the main tubing 1600 is set against the wellbore.

The main tubing 1600 also includes a control station 1612. The control station 1612 is electrically connected over an electrical cable 1614 to the earth surface. The control station 1612 can include a processor and possibly a power and telemetry module to supply power and to communicate signaling. The control station 1612 can also optionally include sensors, such as temperature and/or pressure sensors.

The control station 1612 is electrically connected over a first electrical cable segment 1616 to a first inductive coupler portion 1618. The control station 1612 is also connected over a second electrical cable segment 1620 to another inductive coupler portion 1622. Moreover, the control station 1612 is electrically connected over a third electrical cable segment 1624 to a third inductive coupler portion 1626.

A benefit of using the arrangement of FIG. 26 is that the control station 1612 is directly connected over respective cable segments to corresponding inductive coupler portions, which avoids the issue of power loss due to serial connection of multiple inductive coupler portions.

Figure 27:
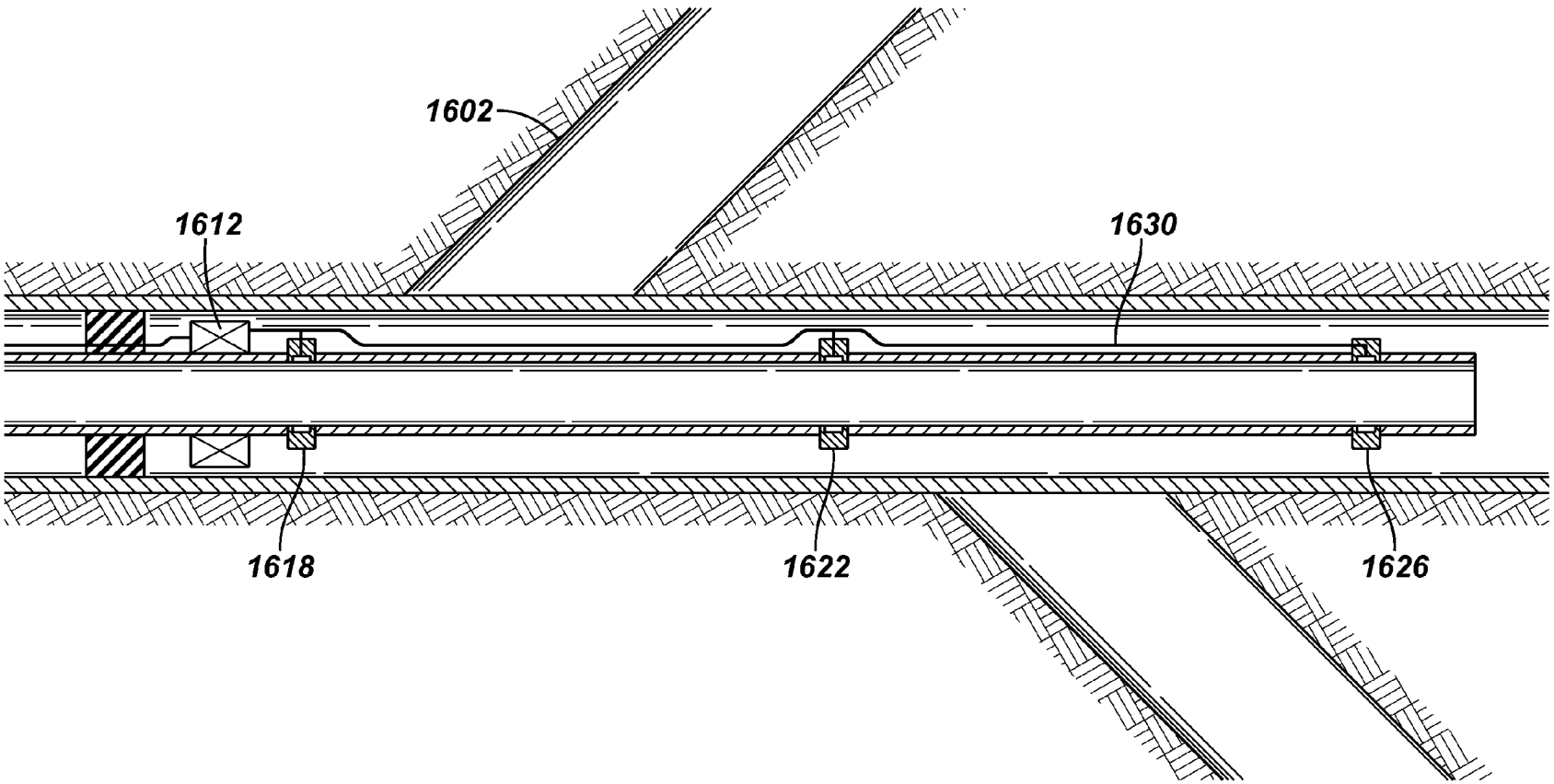

FIG. 27 shows a further communications arrangement, which is modified from the arrangement of FIG. 26 in that a common electrical cable segment 1630 is used to electrically connect the control station 1612 to the inductive coupler portions 1618, 1622, and 1626. In the FIG. 27 implementation, one electrical cable segment is used, rather than three separate electrical cable segments.

Figure 28:
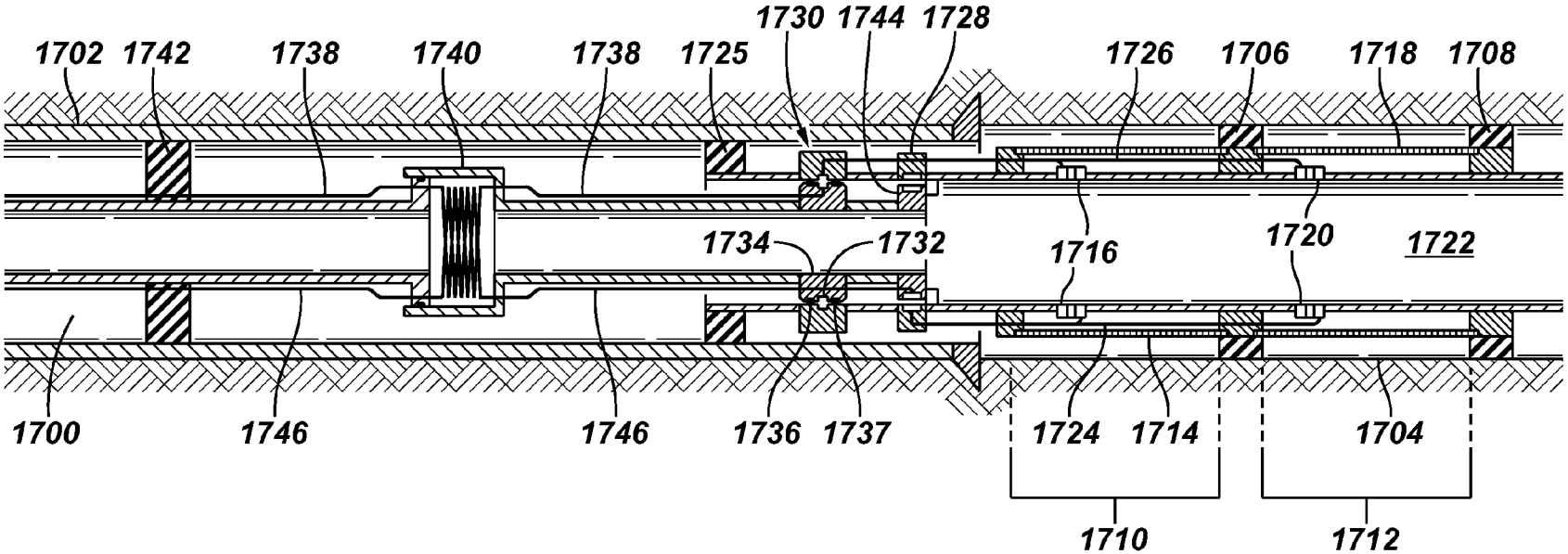
FIGS. 28 and 29 illustrate different electro-hydraulic wet connection mechanisms, according to some embodiments.

FIG. 28 shows a completion system that includes an electro-hydraulic wet connect that allows for wet connection of both electrical signaling, as well as hydraulic control conduits. As depicted, a main wellbore 1700 is lined with casing 1702 that extends partway into the main wellbore 1700. An open hole section 1704 is provided below the casing 1702. The open hole section has the completion assembly deployed that includes isolation packers 1705, 1706 and 1708 to define zones 1710 and 1712. The zone 1710 includes a screen 1714 and an adjustable flow control device 1716, and the zone 1712 includes a screen 1718 and an adjustable flow control device 1720. The flow control devices 1716 and 1720 are used to communicate fluids into the inner bore 1722 of the completion assembly. It is assumed that the flow control devices 1716 and 1720 are actuated using both electrical and hydraulic control signals. As a result, the flow control devices 1716 and 1720 are connected to an electrical cable segment 1724 and a hydraulic control line segment 1726. The electrical cable segment 1724 is electrically connected to an inductive coupler portion 1728, and the hydraulic control line portion 1726 is hydraulically connected to a hydraulic connection mechanism 1730. The hydraulic connection mechanism includes a groove 1732 that can run around the circumference of a connection sub 1734. Seals 1736 and 1737 are provided on the two sides of the groove 1732 to provide a seal against leakage of hydraulic fluids. The groove 1732 allows for hydraulic connection between the hydraulic control line segment 1726 and another hydraulic control line segment 1738, which extends from the hydraulic connection mechanism 1730 to a length compensation joint 1740. The hydraulic control line segment 1738 continues around the length compensation joint 1740 and extends upwardly through a packer 1742.

The hydraulic connection mechanism 1730 is a hydraulic wet connect mechanism that allows for a hydraulic connection to be made in wellbore fluids between an upper completion section and a lower completion section.

The inductive coupler portion 1728 communicates with another inductive coupler portion 1744, which is electrically connected to an electrical cable segment 1746 that extends upwardly through the length compensation joint 1740 and through the packer 1742. The inductive coupler portions 1728 and 1744 enable an electrical wet connect to be made between an upper completion section and a lower completion section.

Figure 29:
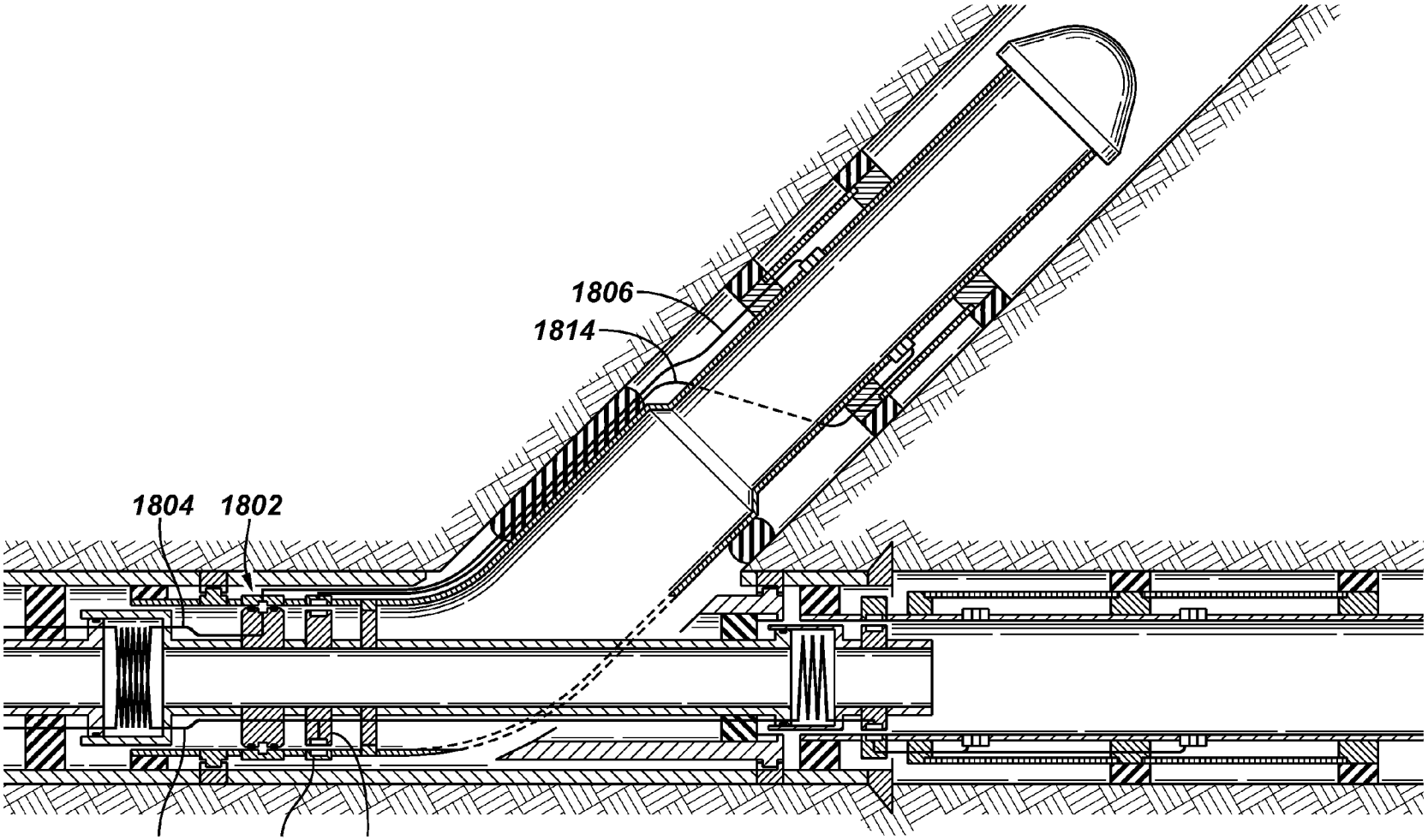

FIG. 29 shows a multilateral completion system that also provides for electro-hydraulic wet connect. As depicted in FIG. 29, a hydraulic wet connect mechanism 1802 similar to the hydraulic wet connect mechanism 1730 of FIG. 28 is provided to allow for hydraulic connection between hydraulic control line segment 1804 and hydraulic control line segment 1806.

Inductive coupler portions 1808 and 1810 form an inductive coupler to electrically couple an electrical cable segment 1812 to an electrical cable segment 1814. The remaining components of FIG. 29 are similar to the multilateral system depicted earlier.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a well, comprising:

a flow control assembly to control fluid flow in a first zone of the well, wherein the flow control assembly has a fixed flow control device and an adjustable flow control device that cooperate to control the fluid flow in the first zone, wherein, the adjustable flow control device comprises: an electric motor; a sealing member moveable by the electric motor to provide at least an open position and a closed position; an outer housing defining an inner chamber; and a shroud having ports; and wherein the adjustable flow control device has an inlet path to receive fluid from outside the adjustable flow control device, wherein the electric motor is provided in the chamber, wherein the shroud is located in the chamber, and wherein the sealing member is moveable inside the shroud to plural positions for controlling fluid flow through the ports of the shroud.

2. The apparatus of claim 1, further comprising a first mandrel and a second mandrel inside the first mandrel, wherein the adjustable flow control device is mounted to the second mandrel, and the fixed flow control device is attached to the first mandrel, wherein fluid flows from the first zone through the fixed flow control device and then through the adjustable flow control device into an inner bore defined by the second mandrel.

3. The apparatus of claim 1, wherein the adjustable flow control device has an inner mandrel that defines an inner bore, and the adjustable flow control device controls fluid flow from outside the flow control device through an inner chamber of the adjustable flow control device and out through an outlet path of the adjustable flow control device to the inner bore of the mandrel.

4. The apparatus of claim 1, wherein the flow control assembly comprises a mandrel to which at least one adjustable flow control device is mounted outside the mandrel.

5. The apparatus of claim 4, wherein the mandrel includes a first longitudinal bore and a longitudinal side pocket, wherein at least one adjustable flow control device is positioned in at least one side pocket.

6. A multilateral completion apparatus for use in a multilateral well that has a main wellbore section and a lateral branch, comprising:

a first flow control assembly positioned in the main wellbore section and a second flow control assembly positioned in the lateral branch, wherein at least one of the first and second flow control assemblies has a fixed flow control device and an adjustable flow control device that cooperate to control fluid flow in a corresponding zone of at least one of the main wellbore section and lateral branch, wherein, the adjustable flow control device comprises: an electric motor; a sealing member moveable by the electric motor to provide at least an open position and a closed position; an outer housing defining an inner chamber; and a shroud having ports; and wherein the adjustable flow control device has an inlet path to receive fluid from outside the adjustable flow control device, wherein the electric motor is provided in the chamber, wherein the shroud is located in the chamber, and wherein the sealing member is moveable inside the shroud to plural positions for controlling fluid flow through the ports of the shroud.

7. The multilateral completion apparatus of claim 6, further comprising:

a lower positioning device for positioning below the lateral branch; and an upper positioning device for positioning above the lateral branch, wherein the lower and upper positioning devices or index casing couplings are azimuthally aligned.

8. The multilateral completion apparatus of claim 7, further comprising a deflector engageable with the lower positioning device to direct equipment toward the lateral branch.

9. The multilateral completion apparatus of claim 7, further comprising a junction liner engageable with the upper positioning device, wherein the junction liner has a window that is orientable by the upper positioning device to align with the main wellbore.

10. The multilateral completion apparatus of claim 9, further comprising a swivel attached to the junction liner to enable the junction liner to freely rotate.

11. The multilateral apparatus of claim 6, further comprising an inductive coupler to provide electrical connection to establish communication and transmit power between the adjustable flow control device and another location.

12. The multilateral apparatus of claim 6, further comprising a connector housing that extends from the main wellbore to the lateral branch, wherein a groove is formed in an outer surface of the connector housing, the groove to carry a control line that is selected from among a power line, a hydraulic line, and a communication line.

13. The multilateral apparatus of claim 6, further comprising plural inductive couplers, and a control station that is electrically connected to the plural inductive couplers.

14. The multilateral completion apparatus of claim 6, further comprising a first mandrel and a second mandrel inside the first mandrel, wherein the adjustable flow control device is mounted to the second mandrel, and the fixed flow control device is attached to the first mandrel, wherein fluid flows from the zone through the fixed flow control device and then through the adjustable flow control device into an inner bore defined by the second mandrel.

15. The multilateral completion system of claim 14, wherein the second mandrel includes a pipe.

* * * * *